US009885971B2

(12) United States Patent
Takeno et al.

(10) Patent No.: US 9,885,971 B2
(45) Date of Patent: Feb. 6, 2018

(54) CHARGING MEMBER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kineo Takeno, Suntou-gun (JP); Noriyuki Doi, Numazu (JP); Masataka Kodama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 15/189,866

(22) Filed: Jun. 22, 2016

(65) Prior Publication Data

US 2016/0378011 A1 Dec. 29, 2016

(30) Foreign Application Priority Data

Jun. 26, 2015 (JP) ..... 2015-129033

(51) Int. Cl.
*G03G 15/00* (2006.01)
*H01B 1/20* (2006.01)
*G03G 15/02* (2006.01)

(52) U.S. Cl.
CPC ..... *G03G 15/0233* (2013.01); *H01B 1/20* (2013.01)

(58) Field of Classification Search
CPC ... H01B 1/00; H01B 1/20; H01B 1/22; H01B 1/24; B41J 2/00; B41J 2/435
See application file for complete search history.

(56) References Cited

U.S. PATENT DOCUMENTS 3,647,429 A * 3/1972 Goldman ..... C07F 7/00 430/56
4,828,917 A * 5/1989 Wegner ..... B05D 1/202 427/372.2
2010/0021834 A1* 1/2010 Badesha ..... G03G 15/2057 430/48
2016/0161877 A1* 6/2016 Masu ..... G03G 15/0233 399/176

FOREIGN PATENT DOCUMENTS

JP 359088867 A * 5/1984
JP 2001-173641 A 6/2001
WO 2015/098117 A1 7/2015

* cited by examiner

*Primary Examiner* — Mark Kopec
(74) *Attorney, Agent, or Firm* — Canon U.S.A., Inc. IP Division

(57) ABSTRACT

There is provided a charging member capable of preventing the occurrence of abnormal discharge at low temperature and low humidity, and capable of preventing the occurrence of an image defect due to abrasion. The charging member includes a support and a surface layer on the support, and the surface layer contains a specific compound.

12 Claims, 7 Drawing Sheets

CHARGING MEMBER, PROCESS CARTRIDGE, AND ELECTROPHOTOGRAPHIC IMAGE FORMING APPARATUS

BACKGROUND OF THE INVENTION

Field of the Invention

The present disclosure relates to a charging member, and a process cartridge and an electrophotographic image forming apparatus (hereinafter referred to as an "electrophotographic apparatus") each using the charging member.

Description of the Related Art

A process for charging the surface of an electrophotographic photosensitive member, hereinafter referred to as a "photosensitive member", is a contact charging process. The contact charging process includes applying a voltage to a charging member disposed in contact with the photosensitive member, generating micro-discharge near a contact portion between the charging member and the photosensitive member, thereby charging the surface of the photosensitive member.

A charging member used in the contact charging process generally has a configuration including a conductive elastic layer from the viewpoint of sufficiently securing a contact portion between the charging member and the photosensitive member. However, the conductive elastic layer contains a low-molecular-weight component, and thus image defects may occur due to bleeding of the low-molecular-weight component on the surface of the charging member. Therefore, for the purpose of preventing the low-molecular-weight component from bleeding on the surface of the charging member, a surface layer may be provided on the conductive elastic layer.

Japanese Patent Laid-Open No. 2001-173641 discloses an electro-conductive roll provided with an electro-conductive roll substrate containing a resinous material; and an inorganic oxide film as a bleed-preventing layer, which is formed by a sol-gel method, and covers a surface of the electro-conductive roll substrate.

In recent years, an electrophotographic apparatus has been desired to be further improved in speed and durability with expansion of applications of the electrophotographic apparatus. In order to realize this, a charging member capable of stably charging a photosensitive member over a long period of time has been demanded.

SUMMARY OF THE INVENTION

One aspect of the present disclosure is directed to provide a charging member capable of preventing the occurrence of locally arose strong electrical discharge, hereinafter referred to as an abnormal discharge, even at low temperature and low humidity, and exhibiting excellent abrasion resistance.

Another aspect of the present disclosure is directed to provide a process cartridge capable stably forming electrophotographic images of high quality and to provide an electrophotographic apparatus.

According to an embodiment of the present disclosure, there is provided a charging member including a support and a surface layer on the support, the surface layer containing a compound represented by a following formula (a).

(a)

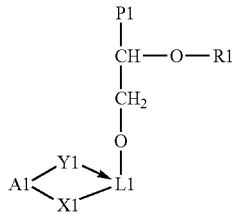

In the formula (a),

P1 represents a resin,

R1 represents a hydrogen atom or an alkyl group having 1 to 4 carbon atoms,

L1 represents polymetalloxane having a structural unit represented by $M1O_{n/2}$ wherein M1 represents at least one metal atom selected from the group consisting of Ti, Zr, Hf, V, Nb, Ta, W, Al, Ga, In, and Ge, when metal atom M1 has a valence of p, n represents an integer of 1 or more and p or less, and X1 represents any one of structures represented by the following formulae (1) to (4).

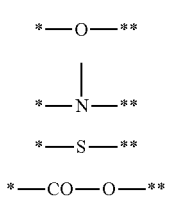

(1)

(2)

(3)

(4)

In the formulae (1) to (4), "*" represents a bonding site with A1, and "**" represents a bonding site with M1 in L1.

Y1 represents a group having a site coordinated with M1 in L1, and (i) when X1 is a structure represented by the formula (1), A1 represents an atomic group necessary for forming a 4- to 8-member ring together with M1, X1, and Y1, and containing an aromatic ring in which a carbon atom constituting the aromatic ring is bonded to an oxygen atom of X1, and (ii) when X1 is a structure represented by any one of the formulae (2) to (4), A1 represents a bond or atomic group necessary for forming a 4- to 8-member ring together with M1, X1, and Y1.

According to another embodiment of the present disclosure, there is provided a charging member including a support and a surface layer on the support, the surface layer containing a compound represented by the following formula (b).

(b)

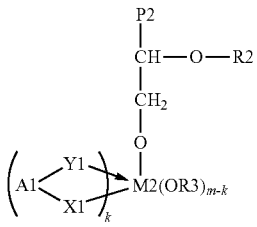

In the formula (b),

P2 represents a resin,

R2 represents a hydrogen atom or an alkyl group having 1 to 4 carbon atoms,

M2 represents at least one metal atom selected from the group consisting of Ti, Zr, Hf, V, Nb, Ta, W, Al, Ga, In, and Ge, R3 represents a hydrogen atom or a hydrocarbon group having 1 to 4 carbon atoms, when metal atom M2 has a valence of q, m represents q−1, and k represents an integer of 1 or more and m or less, and X2 represents any one of structures represented by the following formulae (5) to (8).

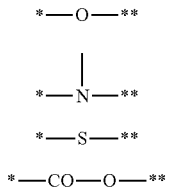

(5)

(6)

(7)

(8)

In the formulae (5) to (8), "*" represents a bonding site with A2, and "**" represents a bonding site with M2.

Y2 represents a group having a site coordinated with M2, and (i) when X2 is a structure represented by the formula (5), A2 represents an atomic group necessary for forming a 4- to 8-member ring together with M2, X2, and Y2, and containing an aromatic ring in which a carbon atom constituting the aromatic ring is bonded to an oxygen atom of X2, and (ii) when X2 is a structure represented by any one of the formulae (6) to (8), A2 represents a bond or atomic group necessary for forming a 4- to 8-member ring together with M2, X2, and Y2.

According to a further embodiment of the present disclosure, there is provided a process cartridge configured to be detachable from an electrophotographic apparatus body and including a photosensitive member and a charging member disposed to be capable of charging the surface of the photosensitive member. The charging member is any one of the charging members described above.

According to a further embodiment of the present disclosure, there is provided an electrophotographic apparatus including a photosensitive member and a charging member disposed to be capable of charging the surface of the photosensitive member. The charging member is any one of the charging members described above.

Further features of the present invention will become apparent from the following description of exemplary embodiments with reference to the attached drawings.

DESCRIPTION OF THE EMBODIMENTS

Figure 1:
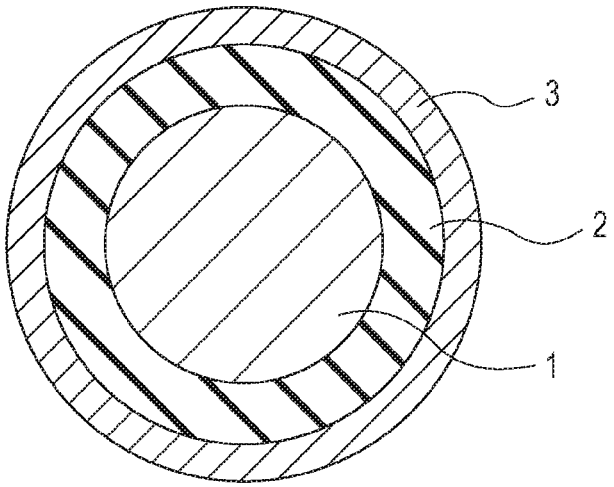
FIG. 1 is a sectional view of a charging member according to an embodiment of the present disclosure.

As a result of examination performed by the inventors, it was found that when a conductive roll according to Japanese Patent Laid-Open No. 2001-173641 is used as a charging member, locally arose strong electrical discharge (abnormal discharge) may occur with increasing process speed, particularly, at low temperature and low humidity. Also, when images are continuously formed for a long period of time, the surface of the conductive roll may be worn, and a dot-shaped defect referred to as a "spot" may occur in an electrophotographic image due to the accumulation of dirt in a worn portion.

As a result of earnest examination for solving the problems described above, the inventors have found that both the suppression or prevention of occurrence of abnormal discharge and an improvement of abrasion resistance can be achieved by a charging member including a surface layer which contains either or both of a compound represented by formula (a) below and a compound represented by formula (b) below.

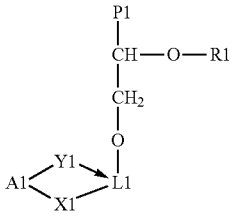

(a)

In the formula (a),

P1 represents a resin,

R1 represents a hydrogen atom or an alkyl group having 1 to 4 carbon atoms,

L1 represents polymetalloxane having a structural unit represented by $M1O_{n/2}$ wherein M1 represents at least one metal atom selected from the group consisting of Ti, Zr, Hf, V, Nb, Ta, W, Al, Ga, In, and Ge, when metal atom M1 has a valence of p, n represents an integer of 1 or more and p or less, and X1 represents any one of structures represented by the following formulae (1) to (4).

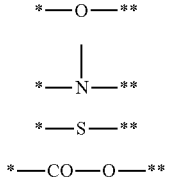

(1)

(2)

(3)

(4)

In the formulae (1) to (4), "*" represents a bonding site with A1, and "**" represents a bonding site with M1 in L1.

Y1 represents a group having a site coordinated with M1 in L1, and (i) when X1 is a structure represented by the formula (1), A1 represents an atomic group necessary for forming a 4- to 8-member ring together with M1, X1, and Y1, and containing an aromatic ring in which a carbon atom constituting the aromatic ring is bonded to an oxygen atom of X1, and (ii) when X1 is a structure represented by any one of the formulae (2) to (4), A1 represents a bond or atomic group necessary for forming a 4- to 8-member ring together with M1, X1, and Y1.

(b)

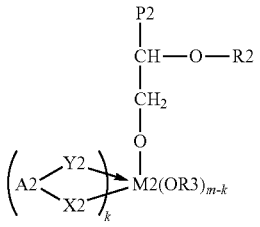

In the formula (b),

P2 represents a resin,

R2 represents a hydrogen atom or an alkyl group having 1 to 4 carbon atoms,

M2 represents at least one metal atom selected from the group consisting of Ti, Zr, Hf, V, Nb, Ta, W, Al, Ga, In, and Ge, R3 represents a hydrogen atom or a hydrocarbon group having 1 to 4 carbon atoms, when metal atom M2 has a valence of q, m represents q−1, and k represents an integer of 1 or more and m or less, and X2 represents any one of structures represented by the following formulae (5) to (8).

(5)

(6)

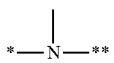

(7)

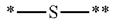

(8)

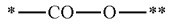

In the formulae (5) to "*" represents a bonding site with A2, and "**" represents a bonding site with M2.

Y2 represents a group having a site coordinated with M2, and (i) when X2 is a structure represented by the formula (5), A2 represents an atomic group necessary for forming a 4- to 8-member ring together with M2, X2, and Y2, and containing an aromatic ring in which a carbon atom constituting the aromatic ring is bonded to an oxygen atom of X2, and (ii) when X2 is a structure represented by any one of the formulae (6) to (8), A2 represents a bond or atomic group necessary for forming a 4- to 8-member ring together with M2, X2, and Y2.

The inventors consider that the reason for the suppression of the occurrence of abnormal discharge in the charging member including the surface layer which contains the compound described above is as follows.

A proximity discharge phenomenon in the atmosphere is generated according to the Paschen's law. This phenomenon is an electron-avalanche diffusion phenomenon involving the repetition of a process in which liberated electrons are accelerated by an electric field and collide with molecules between electrodes and with the electrodes to produce electrons, cations, and anions. The electron avalanche diffuses according to the electric field, and the final discharge charge amount is determined by the diffusion. An excessive electric field in relation to the condition according to the Paschen's law easily causes locally arose strong electrical discharge, that is, abnormal discharge.

Because the number of molecules present between the electrodes at low temperature and low humidity is smaller than that at room temperature and normal humidity, a discharge start voltage tends to be higher than the discharge start voltage induced by the Paschen's law. At a higher discharge start voltage, an electric field easily becomes excessive in relation to the condition according to the Paschen's law, and thus abnormal discharge easily occurs at low temperature and low humidity.

When a ligand having a specified structure is coordinated or bonded to a metal atom in polymetalloxane, metal alkoxide, or metal hydroxide, the highest occupied molecular orbital (HOMO) energy level of a compound according the present disclosure is narrower than that before the ligand is coordinated. As a result, electrons are easily emitted from the surface layer of the charging member according to the present disclosure. It is thus considered that the discharge start voltage is decreased, and the discharge charge amount is suppressed, thereby suppressing the generation of abnormal discharge.

The inventors consider that the reason for excellent abrasion resistance of the charging member including the surface layer containing the compound is as follows.

The inventors know that the surface layer according to Japanese Patent Laid-Open No. 2001-173641 has poor film forming properties and easily causes micro cracks in the surface during film formation. This is considered to be due to the hardness of the surface layer composed of only a metal oxide. The micro cracks present in the surface of the surface layer are considered to cause concentration of stress in the cracks by rubbing with a photosensitive member, and thus it is supposed that abrasion easily progresses from the cracks as a starting point.

On the other hand, the charging member according to the present disclosure is considered to be improved in flexibility of the surface layer because a resin is bonded to polymetalloxane, metal alkoxide, or metal hydroxide constituting the surface layer. Therefore, the film forming properties of the surface layer are improved, and the occurrence of micro cracks during film formation is suppressed, thereby suppressing abrasion of the surface of the charging member.

An embodiment of the present disclosure is described in detail below, but the present invention is not limited to description below.

<Charging Member>

A roller-shaped charging member (hereinafter may be referred to as a "charging roller) is described as the charging roller according to an embodiment of the present disclosure. The shape of the charging member is not limited to a roller shape and may be any desired shape.

FIG. 1 is a sectional view of a charging roller including a conductive elastic layer 2 and a surface layer 3 which are provided on a support 1. The charging roller can use a configuration including the elastic layer 2 for sufficiently securing contact portion with a photosensitive member. Further, one or two or more other layers may be provided between the support 1 and the elastic layer 2 and between the elastic layer 2 and the surface layer 3.

[Surface Layer]

The surface layer 3 contains either or both of the compound represented by the formula (a) and the compound represented by the formula (b).

Each of the compounds represented by the formula (a) and the formula (b) is described in detail below.

<Compound Represented by Formula (a)>

<<Resin (P1)>>

P1 corresponds to a part constituting a binder resin in the surface layer 3.

P1 is preferably an acrylic resin, an epoxy resin, or a phenol resin. Among these, an acrylic resin is preferred because it has excellent flexibility, dimensional stability, and high abrasion resistance.

When P1 is an acrylic resin, specifically, the compound represented by the formula (a) preferably has a structural unit represented by the following formula (11).

(11)

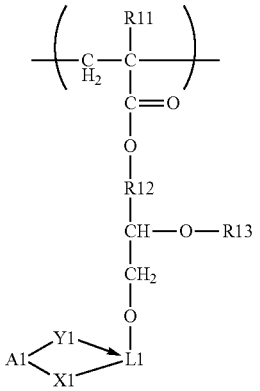

In the formula (11), R11 represents a hydrogen atom or a methyl group, R12 represents a divalent hydrocarbon group having 1 to 4 carbon atoms, and R13 represents a hydrogen atom or a hydrocarbon group having 1 to 4 carbon atoms.

In the formula (11), R12 is preferably a methylene group.

P1 preferably further contains either or both of a structural unit represented by formula (12) below and a structural unit represented by formula (13) below.

(12)

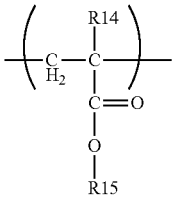

In the formula (12), R14 represents a hydrogen atom or a methyl group, and R15 represents a hydrogen atom or a hydrocarbon group having 1 to 8 carbon atoms.

(13)

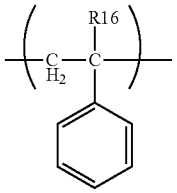

In the formula (13), R16 represents a hydrogen atom or a methyl group.

When P1 further contains either or both of the structural unit represented by the formula (12) and the structural unit represented by the formula (13), the abrasion resistance of the surface of the charging member is further improved.

<<Polymetalloxane (L1)>>

L1 represents polymetalloxane having a structural unit represented by $M1O_{n/2}$ wherein when metal atom M1 has a valence of p, n represents an integer of 1 or more and p or less, and M1 represents at least one metal atom selected from the group consisting of Ti, Zr, Hf, V, Nb, Ta, W, Al, Ga, In, and Ge. L1 may contains a plurality of types of metal atoms of Ti, Zr, Hf, V, Nb, Ta, W, Al, Ga, In, and Ge. Among these, L1 preferably has a structural unit represented by $TiO_{n/2}$ because it has a rigid molecular structure and easily forms a stable metal complex.

<<Ligand>>

A structure constituted by A1, X1, and Y1 is a ligand coordinated and bonded to a metal atom in L1 (polymetalloxane).

A ligand is coordinated and bonded to at least one metal atom in L1. In the formula (a), the ligand need not necessarily be coordinated and bonded to a metal atom directly bonded to an oxygen atom in the formula (a), and the ligand may be coordinated and bonded to any metal atom in L1. The ligand is preferably contained within a range of 0.5 moles or more and 3.5 moles or less, particularly 1 mole or more and 3 moles or less, per mole of an oxygen atom in polymetalloxane. At the ligand content within the range, it is possible to provide the charging member in which the occurrence of abnormal discharge is further suppressed.

In the formula (a), X1 represents any one of structures represented by the following formulae (1) to (4).

(1)

(2)

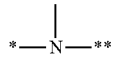

(3)

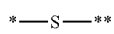

(4)

In the formulae (1) to (4), "*" represents a bonding site with A1, and "**" represents a bonding site with M1 in L1.

In the formula (2), a nitrogen atom may be a nitrogen atom in a heterocycle such as a pyrrole skeleton, an indole skeleton, a pyrrolidine skeleton, a carbazole skeleton, an imidazole skeleton, a benzoimidazole skeleton, a pyrrazole skeleton, an indazole skeleton, a triazole skeleton, a benzotriazole skeleton, a tatrazole skeleton, a pyrrolidone skeleton, a piperidine skeleton, a morpholine skeleton, a piperazine skeleton, or the like. These skeletons may have a substituent. The substituent may be a straight or branched alkyl group or alkoxy group having 1 to 10 carbon atoms and more preferably 1 to 4 carbon atoms (the same is true for substituents described below unless otherwise specified.) When the nitrogen atom is not a nitrogen atom in a heterocycle, an atom or group other than A1 and M1 bonded to the nitrogen atom is a hydrogen atom, a substituted or unsubstituted aryl group, or an alkyl group having 1 to 10 carbon atoms. Examples thereof include aryl groups such as a phenyl group, a naphthyl group, and the like, linear alkyl groups such as a methyl group, an ethyl group, a n-propyl group, a n-butyl group, a n-hexyl group, a n-octyl group, a n-decyl group, and the like, branched alkyl groups such as an isopropyl group, a tert-butyl group, and the like, cyclic alkyl groups such as a cyclopentyl group, a cyclohexyl group, and the like. In particular, a group represented by the formula (2) may be a group in which a hydrogen atom bonded to a nitrogen atom is removed from an unsubstituted amino group, a monoalkylamino group having 1 to 4 carbon atoms, or a group having a pyrrole skeleton.

Y1 in the formula (a) represents a group which has a site coordinated with M1 in L1 and which contains an atom having an unshared electron pair. Examples thereof include a hydroxyl group, an alkoxy group, an aryloxy group, a carbonyl group, an alkylthio group, an arylthio group, a thiocarbonyl group, a substituted or unsubstituted amino group, a substituted or unsubstituted imino group, and the like.

The alkoxy group is, for example, a straight or branched alkoxy group having 1 to 10 carbon atoms. Examples thereof include a methoxy group, an ethoxy group, a n-propoxy group, an isopropoxy group, a n-butoxy group, and a tert-butoxy group. An alkoxy group having 1 to 4 carbon atoms is preferred.

Examples of the aryloxy group include substituted or unsubstituted phenoxy group and naphthyloxy group.

An example of the alkylthio group is a group in which an oxygen atom of an alkoxy group is substituted with a sulfur atom.

An example of the arylthio group is a group in which an oxygen atom of an aryloxy group is substituted with a sulfur atom.

Examples of the carbonyl group include a formyl group, an alkylcarbonyl group, an alkoxycarbonyl group, an arylcarbonyl group, an amide group (R—CO—NR— or —R—NR—CO—), a ureido group ($NH_2$—CO—NH—), and a urea group (R—NH—CO—NH—). Each of alkyl groups of an alkylcarbonyl group and alkoxycarbonyl group and R in an amide group and a urea group is preferably a straight or branched alkyl group having 1 to 10 carbon atoms. Examples of an alkyl group include straight alkyl groups such as a methyl group, an ethyl group, a n-propyl group, a tert-butyl group, a hexyl group, a n-octyl group, a n-nonyl group, and a n-decyl group, and branched alkyl groups such as an isopropyl group and a tert-butyl group. An alkyl group having 1 to 4 carbon atoms is more preferred.

The arylcarbonyl group is, for example, a group having a carbonyl group bonded to a substituted or unsubstituted aromatic hydrocarbon or a group having a carbonyl group bonded to a substituted or unsubstituted aromatic heterocycle. Examples thereof include substituted or unsubstituted phenylcarbonyl group and naphthylcarbonyl group.

The thiocarbonyl group is, for example, a group in which an oxygen atom in the carbonyl group is substituted with a sulfur atom.

The substituted amino group is, for example, an alkylamino group, a dialkylamino group, or a substituted or unsubstituted arylamino group. Examples thereof include monoalkylamino groups having 1 to 10 carbon atoms such as a monomethylamino group, a monoethylamino group, and the like, dialkylamino group having 1 to 10 carbon atoms such as a dimethylamino group, a diethylamino group, an ethylmethylamino group, and the like, and substituted or unsubstituted arylamino groups such as a monophenylamino group, a methylphenylamino group, a diphenylamino group, a naphthylamino group, and the like.

The unsubstituted imino group is a group represented by >C═NH or —N═$CH_2$. A hydrogen atom in the unsubstituted imino group may be substituted with an alkyl group having 1 to 10 carbon atoms or a substituted or unsubstituted aryl group (a phenyl group or naphthyl group).

Also, Y1 may be a group having an aliphatic or aromatic heterocyclic skeleton. Examples of an aromatic heterocyclic skeleton include a thiophene skeleton, a furan skeleton, a pyridine skeleton, a pyran skeleton, a benzothiophene skeleton, a benzofuran skeleton, a quinoline skeleton, an isoquinoline skeleton, an oxazole skeleton, a benzoxazole skeleton, a thiazole skeleton, a benzothiazole skeleton, a thiadiazole skeleton, a benzothiadiazole skeleton, a pyridazine skeleton, a pyrimidine skeleton, a pyrazine skeleton, a phenazine skeleton, an acridine skeleton, a xanthene skeleton, an imidazole skeleton, a benzoimidazole skeleton, a pyrazole skeleton, an indazole skeleton, a triazole skeleton, a benzotrazole skeleton, and a tetrazole skeleton. An example of an aliphatic heterocyclic skeleton is a morpholine skeleton. These heterocyclic skeletons may have a substitute.

In particular, Y1 is preferably a hydroxyl group, an alkoxy group having 1 to 4 carbon atoms, a substituted or unsubstituted phenoxy group, a substituted or unsubstituted naphthyloxy group, a formyl group, an alkylcarbonyl group containing an alkyl group having 1 to 4 carbon atoms, an alkoxycarbonyl group containing an alkoxy group having 1 to 4 carbon atoms, a thiocarbonyl group, a dimethylamide group, a diethylamide group, an ethylmethylamide group, an unsubstituted amino group, a monomethylamino group, a monoethylamino group, a dimethylamino group, a diethylamino group, a monophenylamino group, a methylethylamino group, a methylphenylamino group, a diphenylamino group, a naphthylamino group, an unsubstituted imino group, a methaneimino group, an ethaneimino group, a group having a pyridine skeleton, a group having a quinoline skeleton, or a group having an isoquinoline skeleton.

When X1 is the formula (1), A1 in the formula (a) is an atomic group necessary for forming a 4- to 8-member ring together with M1, X1, and Y1 and contains an aromatic ring in which a carbon atom constituting the aromatic ring is bonded to an oxygen atom of X1. Examples of A1 include atomic groups each containing an aromatic ring (a benzene ring, a naphthalene ring, a pyrrole ring, a thiophene ring, a furan ring, a pyridine ring, an indole ring a benzothiophene ring, a benzofuran ring, a quinoline ring, or an isoquinoline ring). These rings may have a substituent. In particular, A1 is preferably an atomic group containing an aromatic ring (a benzene ring or a naphthalene ring). When A1 is an atomic group containing an aromatic ring, A1 may form a condensed ring with an aromatic heterocyclic ring of Y1, an aromatic heterocyclic ring of X1, or both of the aromatic heterocyclic rings.

When X1 is the formula (1), it is important for A1 to have an aromatic ring. When A1 has an aromatic ring, a metal complex having a structure formed by A1, M1, X1, and Y1 has higher stability, and thus the charging member has higher performance stability.

When X1 is a structure represented by any one of the formulae (2) to (4), A1 in the formula (a) represents a bond or atomic group necessary for forming a 4- to 8-member ring together with M1, X1, and Y1. Examples of A1 include a bond, an alkylene group, and atomic groups each containing an alkylene group, such as a methylene group, an ethylene group, or the like, or an aromatic ring (a benzene ring, a naphthalene ring, a pyrrole ring, a thiophene ring, a furan ring, a pyridine ring, an indole ring, a benzothiophene ring, a benzofuran ring, a quinoline ring, an isoquinoline ring, or the like). The aromatic ring may have a substituent. A1 is particularly preferably a bond, an alkylene group, or an atomic group containing an aromatic ring (a benzene ring or a naphthalene ring).

In the formula (a), a ring formed by A1, M1, X1, and Y1 is preferably a 5- or 6-member ring from the viewpoint of the ease of formation of a complex.

Preferred combinations of A1, X1, and Y1 in the formula (a) include two combinations below.

A1 is a structure represented by formula (A1-1) or (A1-2) below, X1 is a structure represented by formula (X1-1) or (X1-2) below, and Y1 is a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methaneimino group, an ethaneimino group, a group having a pyridine skeleton, a group having a quinoline skeleton, or a group having an isoquinoline skeleton.

(A1-1)

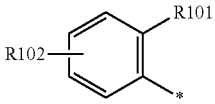

(A1-2)

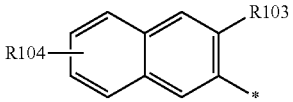

In the formulae (A1-1) and (A1-2), R101 and R103 each independently represent a single bond or methylene group bonded to Y1, R102 and R104 each independently represent a hydrogen atom, a methoxy group, or an ethoxy group, and "*" represents a bonding site with X1.

(X1-1)

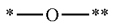

(X1-2)

In the formulae (X1-1) and (X1-2), "*" represents a bonding site with A1, and "**" represents a bonding site with M1.

In the combination described above, when Y1 is a group having a pyridine skeleton, a group having a quinoline skeleton, or a group having an isoquinoline skeleton, an aromatic ring in Y1 may form a condensed ring with an aromatic ring in A1.

In addition, A1 is a bond, a methylene group, an ethylene group, or a trimethylene group, X1 is a structure represented by any one of formulae (X1-3) to (X1-7), and Y1 is a methoxy group, an ethoxy group, a formyl group, a methylcarbonyl group, an ethylcarbonyl group, a methoxycarbonyl group, an ethoxycarbonyl group, dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methaneimino group, an ethaneimino group, a group having a pyridine skeleton, a group having a quinoline skeleton, or a group having an isoquinoline skeleton.

(X1-3)

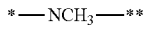

(X1-4)

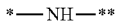

(X1-5)

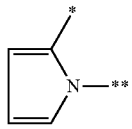

(X1-6)

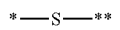

(X1-7)

In the formulae (X1-3) to (X1-7), "*" represents a bonding site with A1, and "**" represents a bonding site with M1.

In the two combinations of A1, X1, and Y1 described above, further a ring formed by A1, M1, X1, and Y1 is preferably a 5- or 6-member ring from the viewpoint of the ease of formation of a complex.

Examples of a compound (hereinafter referred to as a "compound for a ligand") which is coordinated and bonded to a metal atom to form the above-described structure composed of X1, A1, and Y1 are summarized in Tables 1 to 4. In Tables 1 to 4, "Me" represents a methyl group.

Some of the compounds for a ligand shown in Tables 1 to 4 are described in detail below.

When X1 is the formula (4), an example of the compound for a ligand is o-anisic acid represented by the following formula (14).

(14)

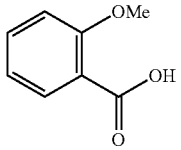

O-anisic acid forms a complex in which a hydrogen atom of a carboxyl group in o-anisic acid is removed, an oxygen atom is bonded to a metal atom, and an oxygen atom of a methoxy group is coordinated with the metal atom. The residual 1,2-phenylene group corresponds to A1.

When X1 is the formula (1), an example of the compound for a ligand is 4-hydroxy-5-azaphenanthrene represented by formula (15) below. 4-Hydroxy-5-azaphenanthrene is a compound for a ligand in which an aromatic ring in A1 is integrated with an aromatic heterocycle of Y1.

(15)

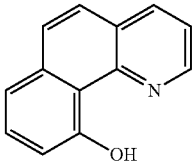

4-Hydroxy-5-azaphenanthrene forms a complex in which a hydrogen atom of a hydroxyl group is removed, an oxygen atom is bonded to a metal atom, and a nitrogen atom of a pyridine skeleton is coordinated with the metal atom. The naphthalene skeleton corresponds to A1, and the pyridine skeleton and the naphthalene skeleton form a condensed ring, thereby forming an azaphenanthrene skeleton.

When X1 is the formula (2), an example of the compound for a ligand is 2-acetylpyrrole represented by the following formula (16).

(16)

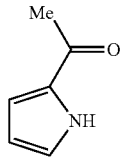

2-Acetylpyrrole forms a complex in which a nitrogen atom of a pyrrole skeleton is bonded to a metal atom, and an oxygen atom of an acetyl group is coordinated with the metal atom. A bond between the acetyl group and the pyrrole group corresponds to A1.

TABLE 1

| | Y1 and Y2 | | | | | | |
|---|---|---|---|---|---|---|---|
| X1 and X2 | Hydroxy group Alkoxy group aryloxy group | Carbonyl group | | | | Alkylthio group arylthio group | Thiocarbonyl group |
| *—O—** | 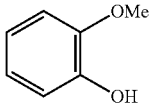 | | | | | 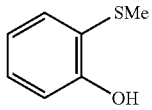 | |
| *—N(|)—** | 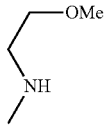 | 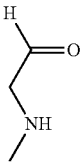 | 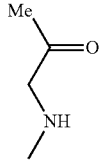 | 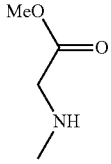 | 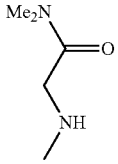 | 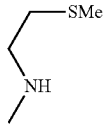 | 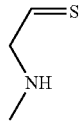 |
| | 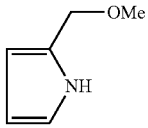 | 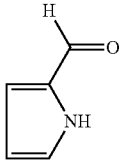 | 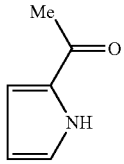 | 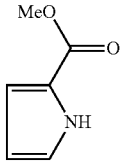 | 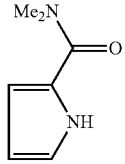 | 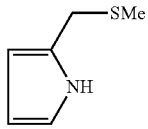 | 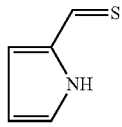 |
| *—S—** | 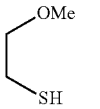 | 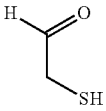 | 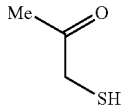 | 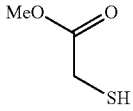 | 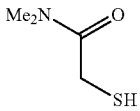 | 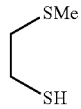 | 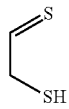 |
| *—CO—O—** | 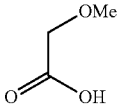 | 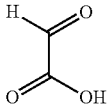 | 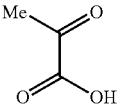 | 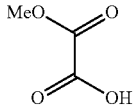 | 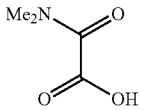 | 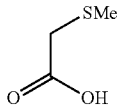 | 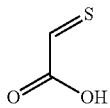 |

TABLE 2
| X1 and X2 | Y1 and Y2: Amino group | Imino group | Heterocycle | | | |
|---|---|---|---|---|---|---|
| *—O—** | 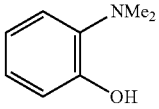 | 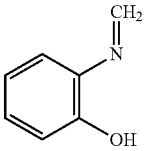 | 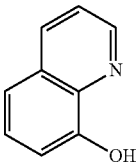 | | | |
| 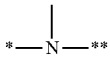 | 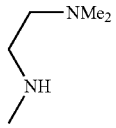 | 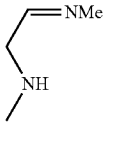 | 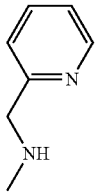 | 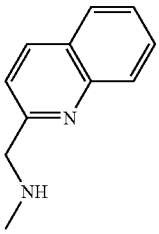 | 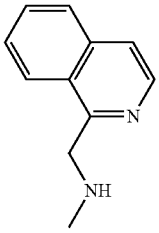 | |
| | 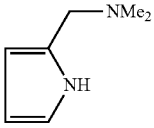 | 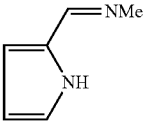 | 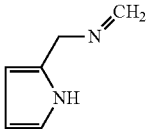 | 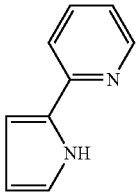 | 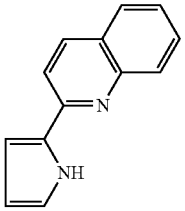 | 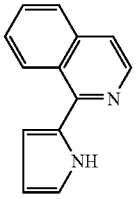 |
| *—S—** | 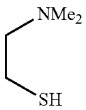 | 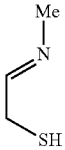 | 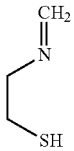 | 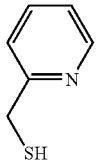 | 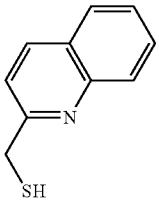 | 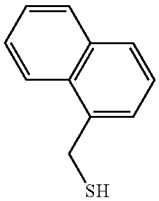 |
| *—CO—O—** | 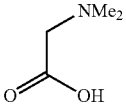 | 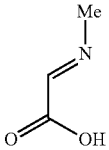 | 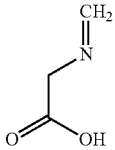 | 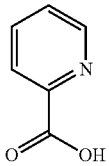 | 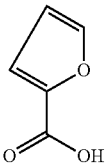 | 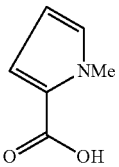 |
| | | | 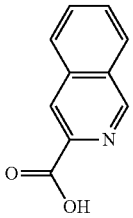 | 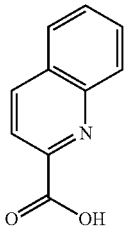 | 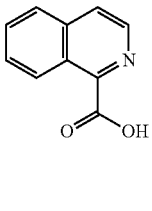 | |

TABLE 3
| X1 and X2 | Y1 and Y2 | | | | | | |
|---|---|---|---|---|---|---|---|
| | Hydroxy group<br>Alkoxy group<br>Aryloxy group | Carbonyl group | | | | alkylthio group<br>arylthio group | hiocarbonyl group |
| *—O—** | 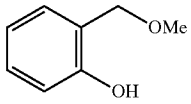 | 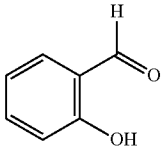 | 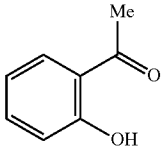 | 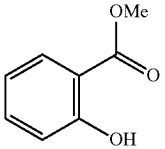 | 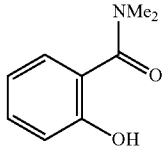 | 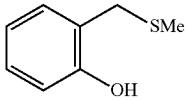 | 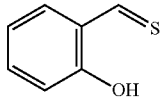 |
| 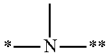 | 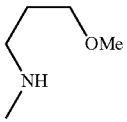 | 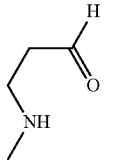 | 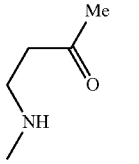 | 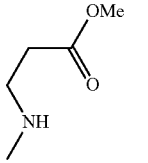 | 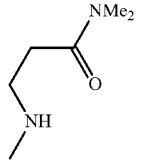 | 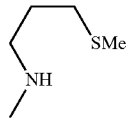 | 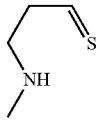 |
| | 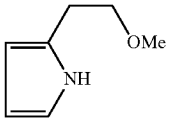 | 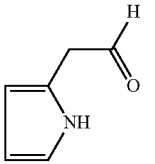 | 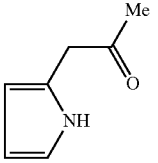 | 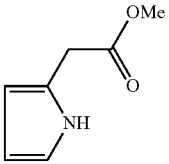 | 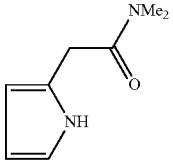 | 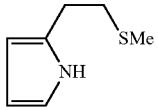 | 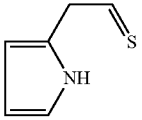 |

TABLE 3-continued
| X1 and X2 | Y1 and Y2 | | | | | | |
|---|---|---|---|---|---|---|---|
| | Hydroxy group<br>Alkoxy group<br>Aryloxy group | Carbonyl group | | | | alkylthio group<br>arylthio group | hiocarbonyl group |
| *—S—** | 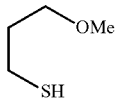 | 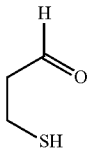 | 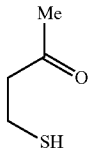 | 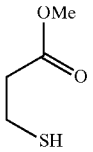 | 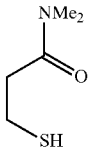 | 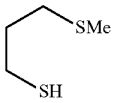 | 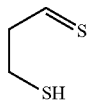 |
| *—CO—O—** | 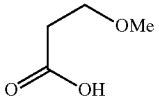 | 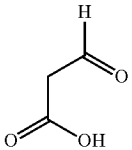 | 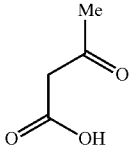 | 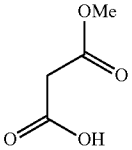 | 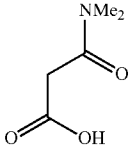 | 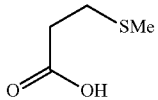 | 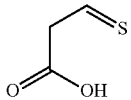 |
| | 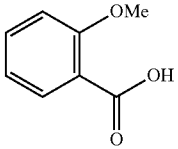 | | | | | 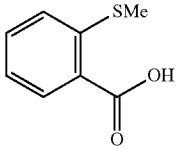 | |

TABLE 4

| X1 and X2 | Y1 and Y2: Amino group | Imino group | | Heterocycle | |
|---|---|---|---|---|---|
| *—O—** | 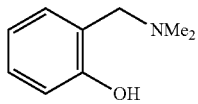 | 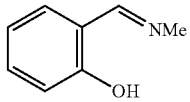 | 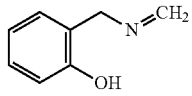 | 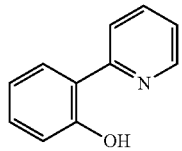 | 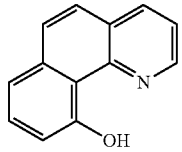 |
| *—N—** | 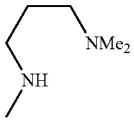 | 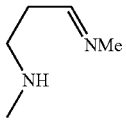 | 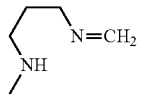 | 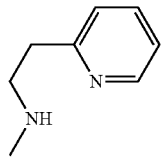 | 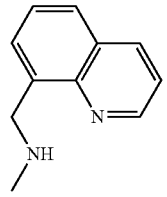 |
| | 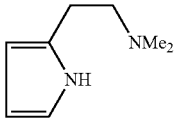 | 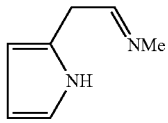 | 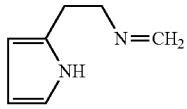 | 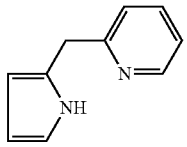 | 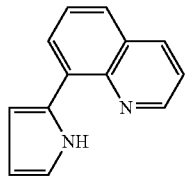 |
| *—S—** | 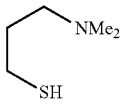 | 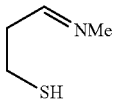 | 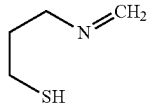 | 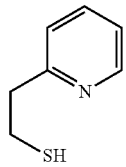 | 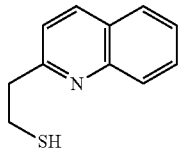 |
| *—CO—O ** | 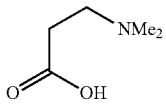 | 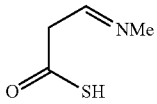 | 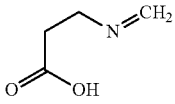 | 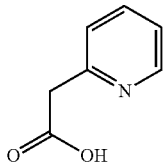 | 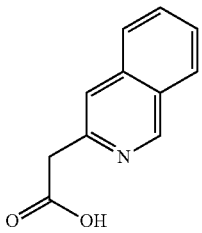 |
| | 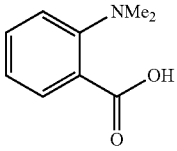 | | | 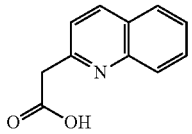 | 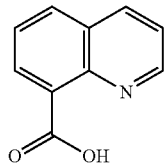 |

(Compound Represented by Formula (b))

The compound represented by the formula (b) has metal alkoxide or metal hydroxide in place of the polymetalloxane in the compound represented by the formula (a).

In the formula (b), P2 represents the same meaning as P1.

For example, when P2 is an acrylic resin, specifically, the compound represented by the formula (b) preferably has a structural unit represented by the following formula (21).

(21)

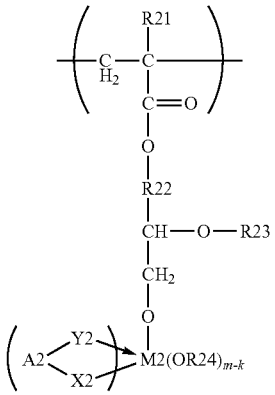

In the formula (21), R21 represents a hydrogen atom or a methyl group, R22 represents a divalent hydrocarbon group having 1 to 4 carbon atoms, R23 represents a hydrogen atom or a hydrocarbon group having 1 to 4 carbon atoms, and R24 represents a hydrogen atom or a hydrocarbon group having 1 to 4 carbon atoms. In the formula (21), R22 is preferably a methylene group.

P2 preferably has either or both of a structural unit represented by formula (22) below and a structural unit represented by formula (23) below.

(22)

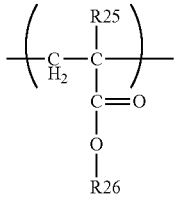

In the formula (22), R25 represents a hydrogen atom or a methyl group, and R26 represents a hydrogen atom or a hydrocarbon group having 1 to 8 carbon atoms.

(23)

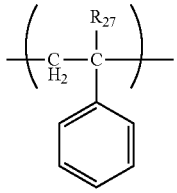

In the formula (23), R27 represents a hydrogen atom or a methyl group.

When P has both the structural units represented by the formulae (22) and (23), the abrasion resistance of the surface of the charging member is further improved.

A structure composed of A2, X2, and Y2 in the formula (b) is a ligand coordinated and bonded to M2. A2, X2, and Y2 each represent the same meaning as A1, X1, and Y1 in the formula (a), and thus description thereof is omitted.

[Formation of Surface Layer]

The surface layer 3 can be formed by applying, on the support 1 or the elastic layer 2, a coating solution prepared by mixing a metal alkoxide, the compound for a ligand described above, and a resin having an epoxy group in an organic solvent, and then drying the resultant coating film.

A commercial epoxy group-containing resin can be used as the resin having an epoxy group. Specifically, examples of an epoxy group-containing acrylic polymer include "Ma-Proof G-0150M" and "Ma-Proof G-2050M" (both are trade names) manufactured by NOF Corporation, and "ARUFON UG-4010" and "ARUFON UG-4040" (both are trade names) manufactured by Toagosei Co., Ltd. Examples of an epoxy group-containing acryl/styrene-based polymer include "Ma-Proof G-0105SA" and "Ma-Proof G-1005S" manufactured by NOF Corporation. Other examples of the epoxy group-containing resin which can be used include epoxy group-containing epoxy resins and epoxy group-containing phenol resins.

In the process for forming the surface layer, the compound represented by the formula (a) is formed by competitive proceeding of the reaction of forming polymetalloxane by condensation of a metal complex of the compound for a ligand coordinated with a metal alkoxide and a simple metal alkoxide and of the reaction of bonding the cleaved epoxy group in the resin to the metal complex or single metal alkoxide. When the condensation reaction of the metal complex with the simple metal alkoxide does not much proceed, a compound having a structure in which the metal complex is reacted with an epoxy group and bonded thereto as shown in the formula (b) is formed.

For example, when o-anisic acid represented by the formula (14) as the compound for a ligand and titanium isopropoxide as the metal alkoxide are mixed at a molar ratio of 2:1 to form a metal alkoxide complex, which is then mixed with an acrylic resin having a glycidyl polymethacrylate unit as the resin having an epoxy group, the resultant compound is considered to have a structure represented by the following formula (31) or formula (32).

(31)

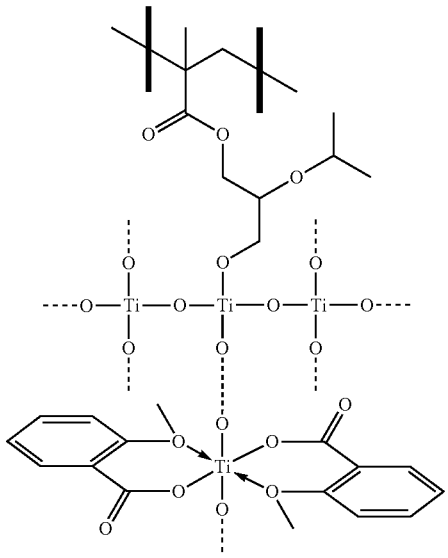

-continued (32)

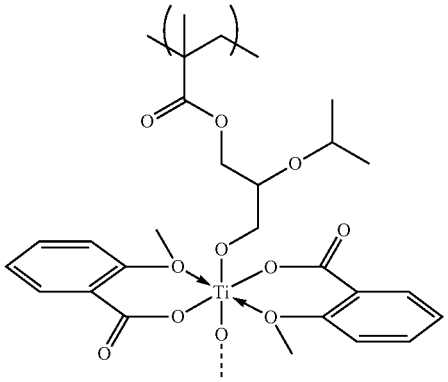

A bond between the metal atom and the compound for a ligand described above can be confirmed by performing $^{1}$H-NMR analysis. Also, a bond between the epoxy group and the metal atom can be confirmed by using a micro MS (micro-sampling mass spectrometry) method.

The resin having an epoxy group is preferably an epoxy group-containing acrylic resin because it has high abrasion resistance and is particularly preferably an epoxy group-containing acrylic resin having a structural unit represented by the following formula (33.

(33)

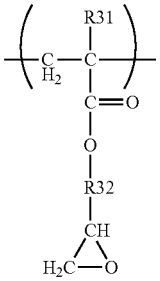

In the formula (33), R31 represents a hydrogen atom or a methyl group, and R32 represents a divalent hydrocarbon group having 1 to 4 carbon atoms.

The structural unit represented by the formula (33) is preferably a glycidyl methacrylate unit.

Examples of a commercial epoxy group-containing acrylic resin having the structure described above include "Ma-Proof C Series" (trade names) manufactured by NOF Corporation and "ARUFON UG-4000 Series" manufactured by Toagosei Co., Ltd.

Further, the epoxy group-containing acrylic resin preferably has either or both of a structural unit represented by formula (34) below and a structural unit represented by formula (35) below.

(34)

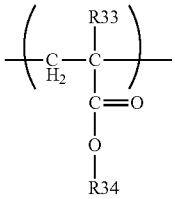

In the formula (34), R33 represents a hydrogen atom or a methyl group, and R31 represents a hydrogen atom or a hydrocarbon group having 1 to 8 carbon atoms.

(35)

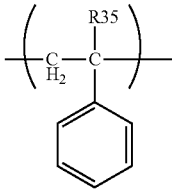

In the formula (35), R35 represents a hydrogen atom or a methyl group.

Specific examples of an epoxy group-containing acrylic polymer having the structures represented by the formula (33) and the formula (34) include "Ma-Proof G-0150M" and "Ma-Proof G-2050M (manufactured by NOF Corporation) and "ARUFON NG-4010" (manufactured by Toagosei Co., Ltd.). Examples of an epoxy group-containing acrylic resin having the structures represented by the formula (33) and the formula (35) include "MA-Proof G-0105SA" (manufactured by NOF Corporation), "Ma-Proof G-1005S (manufactured by NOF Corporation), and "ARUFON NG-4040" (manufactured by Toagosei Co., Ltd.). The "Ma-Proof Series" has a glycidyl methacrylate unit as the structural unit represented by the formula (33).

Examples of the metal alkoxide include alkoxides of titanium, zirconium, hafnium, vanadium, niobium, tantalum, tungsten, aluminum, gallium, indium, and germanium. Examples of the alkoxide include methoxide, ethoxide, n-propoxide, iso-propoxide, n-butoxide, 2-butoxide, and tert-butoxide. When a metal alkoxide containing the compound for a ligand coordinated therewith is available, it can be directly used.

The compound for a ligand is preferably added in an amount of 0.5 mole or more, more preferably 1 mole or more, based on 1 mole of the metal alkoxide. The metal alkoxide is preferably added within a range of 1 mole or more and 500 moles or less, particularly preferably 7.5 moles or more and 500 moles or less, based on 1 mole of the resin.

In addition, a plurality of compounds for a ligand or metal alkoxides may be combined.

The organic solvent is not particularly limited as long as the metal alkoxide, the compound for a ligand, and the epoxy group-containing resin can be dissolved, but an alcohol solvent, an ether solvent, a cellosolve solvent, a ketone solvent, an ester solvent, and the like can be used. Examples of the alcohol solvent include methanol, ethanol, n-propanol, isopropanol, 1-butanol, 2-butanol, tert-butanol, 1-pentanol, and cyclohexanol. Examples of the ether solvent include dimethoxyethane. Examples of the cellosolve solvent include methyl cellosolve and ethyl cellosolve. Examples of the ketone solvent include acetone, methyl ethyl ketone, and methyl iso-butyl ketone. Examples of the ester solvent include methyl acetate, ethyl acetate, and the like. The organic solvents can be used alone or as a mixture of two or more.

A method for forming the surface layer 3 is not particularly limited, and a method generally used can be selected. Examples of the method include coating with a roll coater, dip coating, and ring coating.

After the surface layer 3 is formed, heating can be performed for drying the solvent.

In addition, the surface physical properties such as dynamic friction, surface free energy, etc. can be adjusted by surface treatment of the surface layer 3. Specifically, a method of irradiation with active energy rays can be used, and ultraviolet light, infrared light, or electron beams can be used as the active energy rays.

The thickness of the surface layer 3 is preferably 0.005 μm to 30 μm.

[Support]

The support is required to have rigidity sufficient for contact with the photosensitive member, and a metal material is preferably used. Examples of the metal material include iron, copper, stainless steel, aluminum, an aluminum alloy, and nickel. Also, a support made of a filler-reinforced resin can be used.

[Elastic Layer]

One or two or more elastic materials such as rubber, thermoplastic elastomer, and the like, which have been used for an elastic layer of a charging member, can be used as a material constituting the elastic layer.

Examples of the rubber include urethane rubber, silicone rubber, butadiene rubber, isoprene rubber, chloroprene rubber, styrene-butadiene rubber, ethylene-propylene rubber, polynorbornene rubber, acrylonitrile rubber, epichlorohydrin rubber, alkyl ether rubber, and the like. Examples of the thermoplastic elastomer include styrene-based elastomers, olefin-based elastomers, and the like.

The elastic layer can be configured to contain a conductive agent so as to have predetermined conductivity. The electric resistance value of the elastic layer 2 is within a range of $1.0\times10^{2}\Omega$ or more and $1.0\times10^{8}\Omega$ or less.

Examples of the conductive agent which can be used in the elastic layer, include carbon-based materials, metal oxides, metals, cationic surfactants, anionic surfactants, amphoteric surfactants, antistatic agents, electrolytes, and the like.

Examples of the carbon-based materials include conductive carbon black, graphite, and the like. Examples of the metal oxides include tin oxide, titanium oxide, zinc oxide, and the like. Examples of the metals include nickel, copper, silver, germanium, and the like.

Examples of the cationic surfactants include quaternary ammonium salts (lauryl trimethyl ammonium, stearyl trimethyl ammonium, octadodecyl trimethyl ammonium, dodecyl trimethyl ammonium, hexadecyl trimethyl ammonium, modified fatty acid-dimethyl ethyl ammonium, and the like), perchlorates, chlorates, fluoroborate salts, ethosulfate salts, halogenated benzyl salts (such as benzyl bromide salts, benzyl chloride salts, and the like), and the like.

Examples of the anionic surfactants include aliphatic sulfonic acid salts, higher-alcohol sulfuric acid ester salts, higher-alcohol ethylene oxide-added sulfuric acid ester salts, higher-alcohol phosphoric acid ester salts, and higher-alcohol ethylene oxide-added phosphoric acid ester salts.

Examples of the antistatic agents include nonionic antistatic agents such as higher-alcohol ethylene oxide, polyethylene glycol fatty acid esters, polyhydric alcohol fatty acid esters, and the like.

Examples of the electrolytes include salts (quaternary ammonium salts and the like) of periodic table Group I metals (such as Li, Na, K, and the like) and the like. Examples of the salts of periodic table Group I metals include $LiCF_3SO_3$, $NaClO_4$, $LiAsF_6$, $LiBF_4$, NaSCN, KSCN, and NaCl.

Also, a salt ($Ca(ClO_4)_2$ or the like) of a periodic table Group II metal (such as Ca, Ba, or the like) or an antistatic agent induced from the salt can be used as the conductive agent for the elastic layer. Further, an ionic conductive agent such as a complex of the metal with a polyhydric alcohol (such as 1,4-dutanediol, ethylene glycol, polyethylene glycol, propylene glycol, or polypropylene glycol) or a derivative thereof or a complex with monool (ethylene glycol monoethyl ether or ethylene glycol monoethyl ether) can also be used.

The elastic layer may preferably have a hardness of 60 degrees or more and 85 degrees or less in terms of MD-1 hardness in order to prevent the charging member from deforming even after the charging member is brought into contact with the photosensitive member as a charged body for a long period of time. Also, the elastic layer has a so-called crown shape in which the thickness of a central portion is larger than that at the ends in order to achieve uniform contact with the photosensitive member in the width direction.

<Electrophotographic Apparatus and Process Cartridge>

Figure 2:
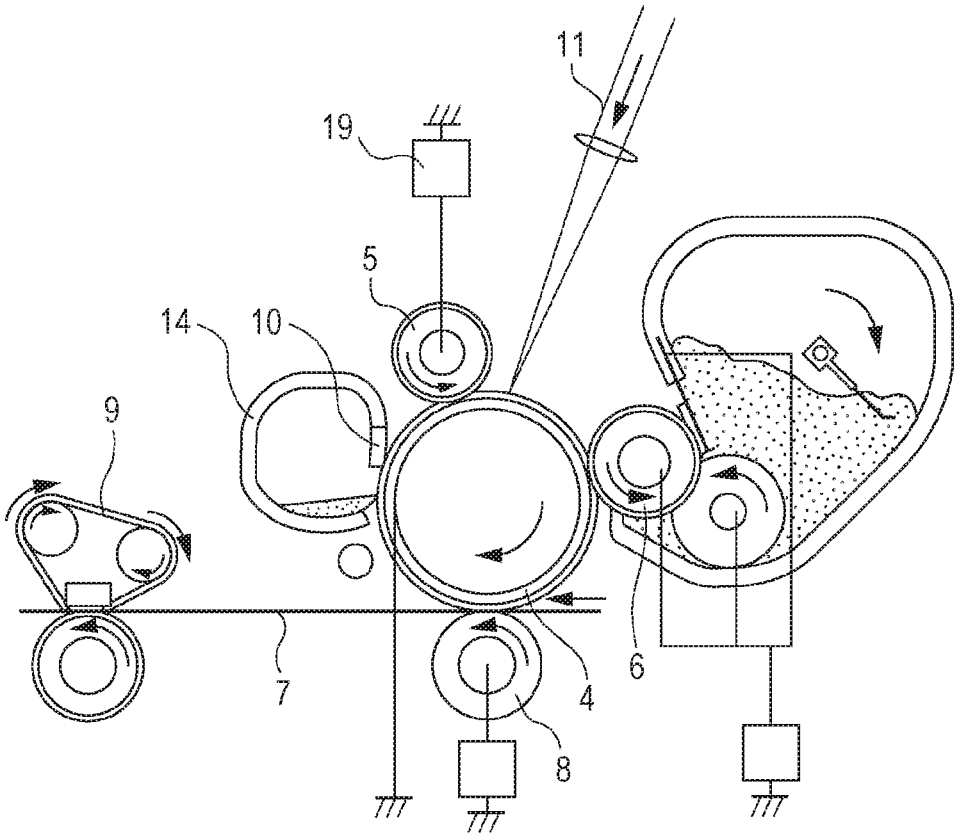
FIG. 2 is a sectional view of an electrophotographic apparatus according to an embodiment of the present disclosure.
Figure 3:
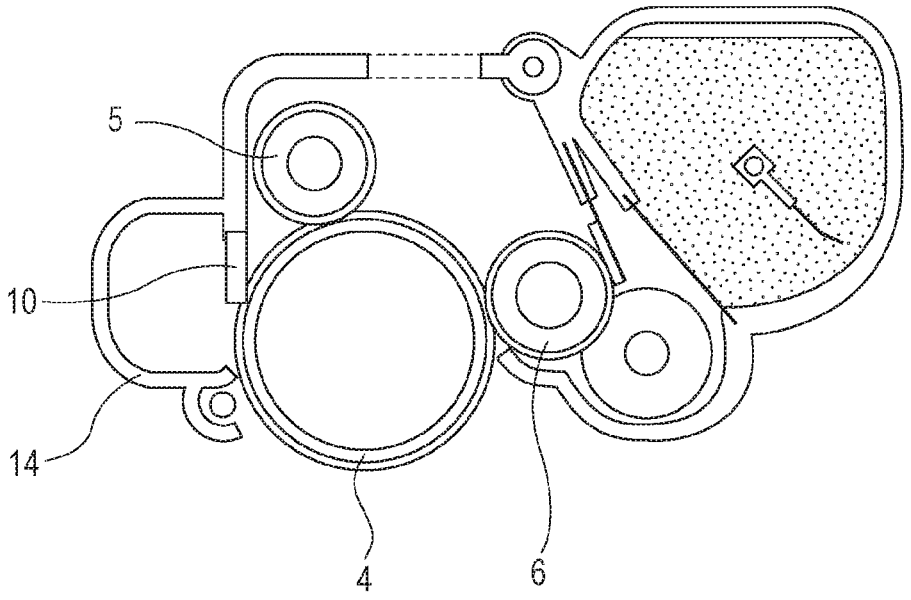
FIG. 3 is a sectional view of a process cartridge according to an embodiment of the present disclosure.

FIG. 2 shows an example of an electrophotographic apparatus including the charging member according to the embodiment of the present disclosure. FIG. 3 shows an example of a process cartridge including the charging member according to the embodiment of the present disclosure.

In FIG. 2, a photosensitive member 4 having a drum shape is rotationally driven at a predetermined circumferential speed in the clockwise direction shown by an arrow in the drawing.

A charging member (hereinafter may be referred to as a "charging roller") 5 has a roller shape and is brought into contact with the surface of the photosensitive member 4 under predetermined pressure. The charging roller 5 is rotationally driven in the forward direction with rotation of the photosensitive member 4. In addition, a predetermined direct current voltage is applied to the charging roller 5 from a charging bias applying power supply 19 (DC charging system).

The charged surface of the photosensitive member 4 is irradiated with image exposure light 11 corresponding to intended image information from an exposure device (not shown). As a result, the light-part potential of the photosensitive member 4 is selectively decreased (attenuated) to form an electrostatic latent image on the photosensitive member 4. A known exposure device such as a laser-beam scanner can be used as the exposure device (not shown).

A developing roller 6 visualizes the electrostatic latent image as a toner image by selectively depositing a toner (negative toner) charged to the same polarity as the charging polarity of the photosensitive member 4 to the exposed light part of the electrostatic latent image on the surface of the photosensitive member 4. A development system is not particularly limited and examples thereof include a jumping development system, a contact development system, and a magnetic brush system. In particular, for an electrophotographic apparatus which outputs color images, the contact development system is preferred from the viewpoint that toner scattering can be effectively suppressed.

A transfer roller 8 is brought into contact with the photosensitive member 4 under predetermined pressure and rotated at substantially the same circumferential rotational speed as the photosensitive member 4 in the forward direction with rotation of the photosensitive member 4. Also, a transfer voltage with polarity opposite to the charging polarity of the toner is applied from a transfer has applying power supply. A transfer material 7 is supplied with predetermined timing to a contact portion between the photosensitive member 4 and the transfer roller 8 from a paper feed mechanism (not shown). The back surface of the transfer material 7 is charged to polarity opposite to the charging polarity of the toner by the transfer roller 8 to which the transfer voltage has been applied. Consequently, the toner image on the photosensitive member side is electrostatically transferred to the surface side of the transfer material 7 in the contact portion between the photosensitive member 4 and the transfer roller 8. A known transfer unit can be used as the transfer roller 8. Specifically, for example, a transfer roller including a conductive metal support coated with an elastic layer adjusted to medium resistance can be used.

The transfer material 7 to which the toner image has been transferred is separated from the surface of the photosensitive member 4, introduced into a fixing device 9, and then output as an image-formed material after fixing of the toner image. In the case of a both-side image forming mode or multiple image forming mode, the image-formed material is introduced into a recycling conveyor mechanism (not shown) and again introduced into the transfer part. The residue such as transfer residual toner on the photosensitive member 4 is recovered from the photosensitive member 4 by a cleaning device 14 having a cleaning blade 10. Also, when residual charge remains on the photosensitive member 4, the residual charge on the photosensitive member 4 may be removed by a pre-exposure device (not shown) after transfer before primary charging by the charging roller 5. In the examples described below, an image was formed without using the pre-exposure device.

A process cartridge according to an embodiment of the present disclosure is configured to integrally support the charging member and the photosensitive member and to be detachable from an electrophotographic apparatus body. Each of the examples described below uses a process cartridge comprising the charging roller 5, the photosensitive member 4, the developing roller 6, and the cleaning device 14 which are integrally supported.

According to an embodiment of the present disclosure, it is possible to provide a charging member which can suppress the occurrence of locally arose strong electrical discharge (abnormal discharge) even at low temperature and low humidity and which has a surface with excellent abrasion resistance. According to another embodiment of the present disclosure, it is possible to provide a process cartridge and electrophotographic apparatus capable of stably forming an electrophotographic image of high quality.

EXAMPLES

The present disclosure is described in further detail below by giving examples. With respect to compounds in the examples, "parts" represents "parts by mass" unless otherwise specified.

Table 5 shows a list of details of reagents used in the examples below.

TABLE 5

| Symbol | Name | CAS No. | Maker | Remarks |
|---|---|---|---|---|
| S101 | 2-Butanol | 78-92-2 | Kanto Chemical Co., Inc. | Special grade |
| S102 | Ethanol | 64-17-5 | Kishida Chemical Co., Ltd. | Special grade |
| S103 | Methyl ethyl ketone | 78-93-3 | Kishida Chemical Co., Ltd. | First grade |
| P101 | Epoxy group-containing acrylic polymer "Ma Proof G-0150M" | | NOF Corporation | Weight-average molecular weight (Mw) = 8000-10000, Epoxy equivalent = 310(g/eq.) |
| P102 | Epoxy group-containing acrylic polymer "Ma Proof G-2050M" | | NOF Corporation | Mw = 200000-250000, Epoxy equivalent = 340(g/eq.) |
| P103 | Epoxy group-containing acrylic-styrene polymer "Ma Proof G-0105SA" | | NOF Corporation | Mw = 10000, Epoxy equivalent = 3000(g/eq.) |
| P104 | Epoxy group-containing acrylic-styrene polymer "Ma Proof G-1005S" | | NOF Corporation | Mw = 100000, Epoxy equivalent = 3300(g/eq.) |
| P105 | Epoxy group-containing acrylic polymer "ARUFON UG-4010" | | Toagosei Co., Ltd. | Mw = 2900, Epoxy value = 1.4(meq/g) |
| P106 | Epoxy group-containing acrylic polymer "ARUFON UG-4040" | | Toagosei Co., Ltd. | Mw = 11000, Epoxy value = 2.1(meq/g) |
| M101 | Titanium isopropoxide | 546-68-9 | Kishida Chemical Co., Ltd. | |
| M102 | Aluminum sec-butoxide | 2269-22-9 | Gelest | |
| L101 | O-anisic acid | 579-75-9 | Tokyo Chemical Industry Co., Ltd. | |
| L102 | 2-Acetylpyrrole | 1072-83-9 | Tokyo Chemical Industry Co., Ltd. | |
| L103 | Quinaldic acid | 93-10-7 | Tokyo Chemical Industry Co., Ltd. | |
| L104 | Acetylacetone | 123-54-6 | Tokyo Chemical Industry Co., Ltd. | |

"Ma-Proof G-0150M", "Ma-Proof G-2050M", and "ARUFON UG-4010" are each an acrylic resin having the structural unit represented by the formula (33) and the structural unit represented by the formula (34).

"Ma-Proof G-0105SA", "Ma-Proof G-1005S", and "ARUFON UG-4040" are each an acrylic resin having the structural unit represented by the formula (33) and the structural unit represented by the formula (35). The "Ma- Proof Series" has a glycidyl methacrylate unit as the structural unit represented by the formula (33).

(Preparation of Coating Solution)

[Coating Solution E1]

(STEP 1)

<Preparation of Epoxy Group-Containing Polymer Solution>

In a glass container of 200 mL, 97.0 g of methyl ethyl ketone and 3.01 g of epoxy group-containing acrylic polymer (trade name "Ma-Proof G-0150M" manufactured by NOF Corporation) were weighed and stirred to prepare a methyl ethyl ketone solution of the epoxy group-containing acrylic polymer.

<Preparation of Metal Alkoxide Solution>

In a glass container of 200 mL, 47.6 g of ethanol and 2.33 g of titanium isopropoxide were placed and stirred to prepare an ethanol solution of the titanium isopropoxide.

<Preparation of Solution of Compound for Ligand>

In a glass container of 200 mL, 2.54 g of o-anisic acid and 47.6 g of ethanol were placed and stirred to prepare an ethanol solution of o-anisic acid.

<Preparation of Metal Complex Solution>

The ethanol solution of o-anisic acid was added to the ethanol solution of the titanium isopropoxide prepared as described above and then stirred and mixed. It is considered that in the resultant solution, titanoxane bond is formed by hydrolysis reaction and condensation reaction of titanium isopropoxide and a complex is formed by coordination of o-anisic acid to a titanium atom.

(Step 2)

In a glass container of 100 mL, 50.0 g of the epoxy group-containing polymer solution prepared in (STEP 1) and 5.0 g of the metal complex solution prepared in (STEP 1) were placed and stirred to prepare a coating solution E1.

[Coating Solution E2 to Coating Solution E8]

The amounts of the epoxy group-containing polymer solution and metal complex solution used in (STEP 2) were changed as shown in Table 6. With exception of this point, coating solution E2 to coating solution E8 were prepared by the same method as for the coating solution E1.

[Coating Solution E9 to Coating Solution E13]

The epoxy group-containing polymer was changed as shown in Table 6, and the formulation was changed as shown in Table 6. With exception of this point, coating solution E9 to coating solution E13 were prepared by the same method as for the coating solution E1.

[Coating Solution E14 to Coating Solution E15]

The compound for a ligand was changed as shown in Table 6, and the formulation was changed as shown in Table 6. With exception of this, coating solution E14 to coating solution E15 were prepared by the same method as for the coating solution E1.

[Coating Solution E16]

The metal alkoxide was changed as shown in Table 6, and the formulation was changed as shown in Table 6. With exception of this, coating solution E16 was prepared by the same method as for the coating solution E1.

[Coating Solution C1]

In a glass container of 200 mL, 96.9 g of methyl isobutyl ketone and 3.02 g of "Ma-Proof G-0150M" were placed and stirred to prepare a coating solution C1.

[Coating Solution C2]

In a glass container of 200 mL, 47.5 g of ethanol and 3.23 g of titanium isopropoxide were placed and stirred to prepare an ethanol solution of the titanium isopropoxide.

In a glass container of 200 mL, 2.30 g of acetylacetone and 46.9 g of ethanol were placed and stirred to prepare an ethanol solution of acetylacetone.

The ethanol solution of acetylacetone was added to the ethanol solution of the titanium isopropoxide prepared as described above and then stirred and mixed to prepare a coating solution C2. It is considered that in the resultant coating solution C2, titanoxane bond is formed by hydrolysis reaction and condensation reaction of titanium isopropoxide and a complex is formed by coordination of acetylacetone to a titanium atom.

TABLE 6

| | | | STEP 1 | | | | | | |
|---|---|---|---|---|---|---|---|---|---|
| | | | Metal complex solution (1) | | | | | | |
| | | Coating | Metal alkoxide (M) | | M Solvent | | Compound for ligand (L) | | L Solvent |
| | | solution No. | Material symbol | Adding amount (g) | Material symbol | Adding amount (g) | Material symbol | Adding amount (g) | Material symbol |
| Example | 1 | E1 | M101 | 2.33 | S102 | 47.6 | L101 | 2.54 | S102 |
| | 2 | E2 | M101 | 2.33 | S102 | 47.6 | L101 | 2.53 | S102 |
| | 3 | E3 | M101 | 2.32 | S102 | 47.5 | L101 | 2.54 | S102 |
| | 4 | E4 | M101 | 2.33 | S102 | 47.6 | L101 | 2.54 | S102 |
| | 5 | E5 | M101 | 2.33 | S102 | 47.6 | L101 | 2.53 | S102 |
| | 6 | E6 | M101 | 2.32 | S102 | 47.5 | L101 | 2.54 | S102 |
| | 7 | E7 | M101 | 2.33 | S102 | 47.6 | L101 | 2.55 | S102 |
| | 8 | E8 | M101 | 2.34 | S102 | 47.5 | L101 | 2.54 | S102 |
| | 9 | E9 | M101 | 2.33 | S102 | 47.6 | L101 | 2.54 | S102 |
| | 10 | E10 | M101 | 2.33 | S102 | 47.6 | L101 | 2.55 | S102 |
| | 11 | E11 | M101 | 2.34 | S102 | 47.6 | L101 | 2.54 | S102 |
| | 12 | E12 | M101 | 2.33 | S102 | 47.6 | L101 | 2.54 | S102 |
| | 13 | E13 | M101 | 2.33 | S102 | 47.6 | L101 | 2.55 | S102 |
| | 14 | E14 | M101 | 2.33 | S102 | 47.6 | L102 | 2.39 | S102 |
| | 15 | E15 | M101 | 2.33 | S102 | 47.6 | L103 | 2.60 | S102 |
| | 16 | E16 | M102 | 2.28 | S101 | 47.6 | L101 | 2.76 | S101 |
| Comparative Example | 1 | C1 | M101 | 3.23 | S102 | 47.5 | L104 | 2.30 | S102 |
| | 2 | C2 | — | — | — | — | — | — | — |

TABLE 6-continued

| | | STEP 1 | | | | | STEP 2 | |
|---|---|---|---|---|---|---|---|---|
| | | Metal complex solution (1) | Resin soution (2) | | | | Amount of metal complex solution (1) used (g) | Amount of resin solution (2) used (g) |
| | | L Solvent | Resin (P) | | P Solvent | | | |
| | | Adding amount (g) | Material symbol | Adding amount (g) | Material symbol | Adding amount (g) | | |
| Example | 1 | 47.6 | P101 | 3.01 | S103 | 97.0 | 50.0 | 5.0 |
| | 2 | 47.5 | P101 | 3.00 | S103 | 97.0 | 50.0 | 0.5 |
| | 3 | 47.5 | P101 | 3.00 | S103 | 97.1 | 50.0 | 1.5 |
| | 4 | 47.5 | P101 | 3.00 | S103 | 97.0 | 50.0 | 2.5 |
| | 5 | 47.6 | P101 | 3.01 | S103 | 97.1 | 50.0 | 10.0 |
| | 6 | 47.5 | P101 | 3.00 | S103 | 97.0 | 50.0 | 30.0 |
| | 7 | 47.5 | P101 | 3.01 | S103 | 97.1 | 50.0 | 50.0 |
| | 8 | 47.6 | P101 | 3.01 | S103 | 97.0 | 50.0 | 75.0 |
| | 9 | 47.6 | P102 | 3.00 | S103 | 97.0 | 50.0 | 5.0 |
| | 10 | 47.6 | P103 | 3.00 | S103 | 97.0 | 50.0 | 5.0 |
| | 11 | 47.6 | P104 | 3.01 | S103 | 97.0 | 50.0 | 5.0 |
| | 12 | 47.6 | P105 | 3.00 | S103 | 97.0 | 50.0 | 5.0 |
| | 13 | 47.6 | P106 | 3.00 | S103 | 97.0 | 50.0 | 5.0 |
| | 14 | 46.9 | P101 | 3.00 | S103 | 97.0 | 50.0 | 5.0 |
| | 15 | 47.7 | P101 | 3.01 | S103 | 97.0 | 50.0 | 5.0 |
| | 16 | 47.4 | P101 | 3.00 | S103 | 97.0 | 50.0 | 5.0 |
| Comparative Example | 1 | 46.9 | — | — | — | — | — | — |
| | 2 | — | P101 | 3.02 | S103 | 96.9 | — | — |

Example 1

[Formation of Conductive Elastic Roller]

The materials shown in Table 7 below were mixed by a 6 L pressure kneader (trade name, TD6-15MDX manufactured by Toshin Co., Ltd.) at a filling rate of 70 vol % and a blade rotational speed of 30 rpm for 24 minutes to produce an unvulcanized rubber composition. Then, 4.5 parts of tetrabenzylthiuram disulfide [trade name: Sanceler TBzTD, manufactured by Sanshin Chemical Industry Co., Ltd.] serving as a vulcanization accelerator and 1.2 parts of sulfur as a vulcanization agent were added to 174 parts by mass of the unvulcanized rubber composition. Cutting back to right and left was performed 20 times by using an open roll having a roll diameter of 12 inches at a front roll rotational speed of 8 rpm, a rear roll rotational speed of 10 rpm, and a roll gap of 2 mm. Then, the mixture was passed 10 times through a roll gap of 0.5 mm to produce a kneaded material for forming a conductive elastic layer.

TABLE 7

| Raw material | Amount of use (parts by mass) |
|---|---|
| Medium-high nitrile NBR (trade name: Nipol DN219, manufactured by Zeon Corporation) | 100 |
| Carbon black for color (trade name: #7360, manufacture by Tokai Carbon Co., Ltd.) | 48 |
| Calcium carbonate (trade name: Nanox #30 manufactured by Maruo Calcium Co., Ltd.) | 20 |
| Zinc oxide (trade name: zinc oxide type 2, manufactured by Sakai Chemical Industry Co., Ltd.) | 5 |
| Stearic acid (trade name: zinc stearate, manufactured by NOF Corporation) | 1 |

Next, a cylindrical steel-made support (with the surface plated with nickel, hereinafter referred to as a "core") having a diameter of 6 mm and a length of 252 mm was prepared. Then, a thermosetting adhesive (trade name: Metaloc U-20, manufactured by Toyo Kagaku Kenkyusho Co., Ltd.) containing a metal and rubber was applied to the core in a region (region with a width of 231 mm in total in the axial direction) of 115.5 mm to both sides from the center in the axial direction. Then, the support was dried at a temperature of 80° C. for 30 minutes and further dried at a temperature of 120° C. for 1 hour.

The kneaded material and the core with an adhesive layer used as a center were simultaneously coaxially extruded into a cylinder having an outer diameter of 8.75 to 8.90 mm by extrusion molding using a crosshead. The end portions were cut to form the core having an unvulcanized conductive elastic layer laminated on the outer periphery thereof. The extruder used had a cylinder diameter 70 mm and L/D=20, and the temperature during extrusion was controlled so that the temperatures of the head, cylinder, and screw were 90° C.

Next, the roller including the unvulcanized conductive elastic layer formed thereon was vulcanized by using a continuous heating furnace having two zones set to different temperatures. The temperature of a first zone of the continuous heating furnace was set to 80° C. and the temperature of a second zone was set to 160° C., and the roller was passed through each of the zones for 30 minutes.

Next, both ends of the conductive elastic layer portion (rubber portion) of the roller after heating were cut to form a conductive elastic layer portion having a width of 232 mm in the axial direction. Then, the surface of the conductive elastic layer portion was polished by a rotary grindstone (work rotational speed: 333 rpm, grindstone rotational speed: 2080 rpm, polishing time: 12 sec). As a result, a crown-shaped conductive elastic roller was produced, in which the diameter at the ends was 8.26 mm, the diameter of a central portion was 3.50 mm, the ten-point mean roughness Rz of the surface was 5.5 m, the runout was 18 m, and the harness was 73 degrees (Asker C).

The ten-point mean roughness $R_{ZJIS}$ of the conductive elastic roller was measured according to JIS B0601:2001. The run-out was measured by using a high-precision laser measuring instrument (trade name: LSM430v, manufactured by Mitutoyo Co., Ltd.). In detail, the outer diameter was measured by using the measuring instrument, a difference between the maximum outer diameter value and the minimum outer diameter value was measured as outer diameter difference runout. The measurement was performed at 5 points, and an average value of outer diameter runputs at 5 points was regarded as the runout of a measured object. The Asker C hardness was measured in a measurement environment of 25° C. and 55% RH under a condition in which a push needle of an Asker C-type hardness meter (manufactured by Kobunshi Keiki Co., Ltd.) was brought into contact with the surface of the measured object with a load of 1000 g applied.

[Formation of Surface Layer]

Next, the coating solution E1 was applied to the conductive elastic roller 1 by ring coating with a discharge amount of 0.120 ml/s ring part speed: 85 mm/s, total discharge amount: 0.130 ml). The coating film was died by being allowed to stand at room temperature and normal humidity, and then, the roller was irradiated with ultraviolet light at a wavelength of 254 nm so that an integral light quantity was 9000 mJ/cm$^2$, thereby forming a surface layer. Ultraviolet irradiation was performed by using a low-pressure mercury lamp (manufactured by Toshiba Lighting & Technology Corporation (previously Harison Toshiba Lighting Corporation)). A charging member E1 was produced as described above.

[Structural Analysis]

The structure of a compound contained in the surface layer of the charging member E1 was analyzed by a micro-sampling mass spectrometry (micro MS) method.

The surface layer of the charging member E1 was thinly cut by using a bio-cutter and collected in an amount of 60 ng used as a measurement sample. An ion trap mass spectrometer (trade name: Polaris Q, manufactured by Thermo Electron Corporation) was used as the measuring meter.

Specifically, the measurement sample was fixed to a filament positioned at the end of a probe and introduced directly into an ionization chamber. The measurement sample was heated from room temperature to 1000° C. at a constant heating rate (10° C./sec), an evaporated sample was ionized by irradiation with electron beams and detected by a mass spectrometer. Ionization was performed under conditions including an ionization voltage of 70 eV, an ion source temperature of 200° C., and a measurement mass range of m/z=45 to 650.

Similarly, the compounds contained in the metal complex solution and epoxy group-containing polymer solution used for preparing the coating solution E1 were analyzed by the micro MS method. A measurement sample was prepared as follows. Two aluminum sheets having surfaces degreased with ethanol were prepared. Each of the metal complex solution and the epoxy group-containing polymer solution was dropped on the degreased surface of each of the sheets. Next, a film was formed on each of the sheets by rotating each sheet at 300 rpm for 2 seconds. Then, the sheet was dried in an environment of room temperature and normal humidity (temperature: 23° C., relative humidity: 50%) for 60 minutes. Further, each of the sheets was placed in a hot-air circulation drying furnace and dried at 80° C. for 60 minutes. The film formed on the surface of each of the sheets was separated from each of the sheets and then ground to form a measurement sample.

The analysis results are shown in FIGS. 4 to 6B.

Figure 4:
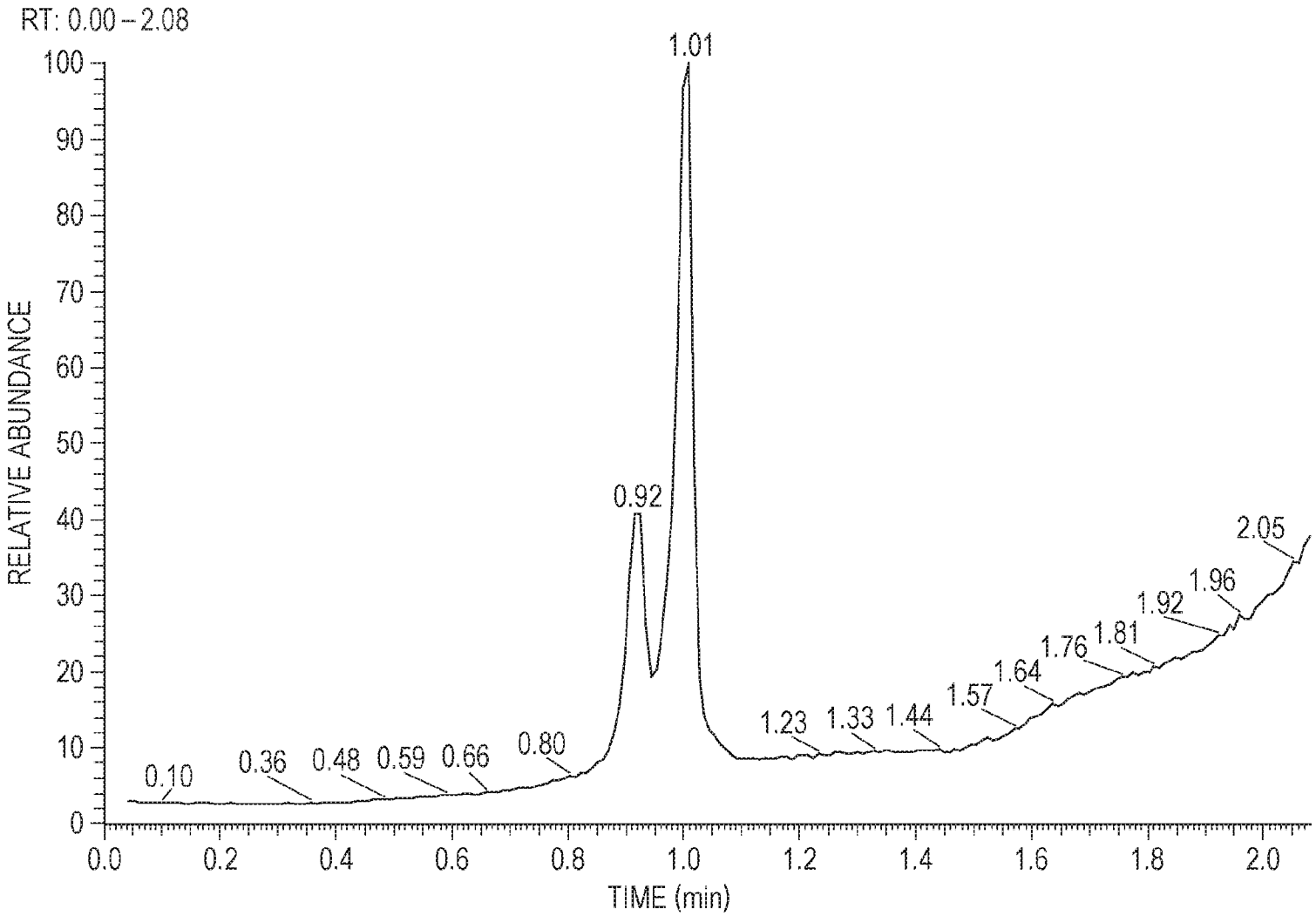
FIG. 4 is an ion chromatogram of an example of a surface layer.

FIG. 4 is a total ion chromatogram of the surface layer of the charging member E1.

Figure 5A:
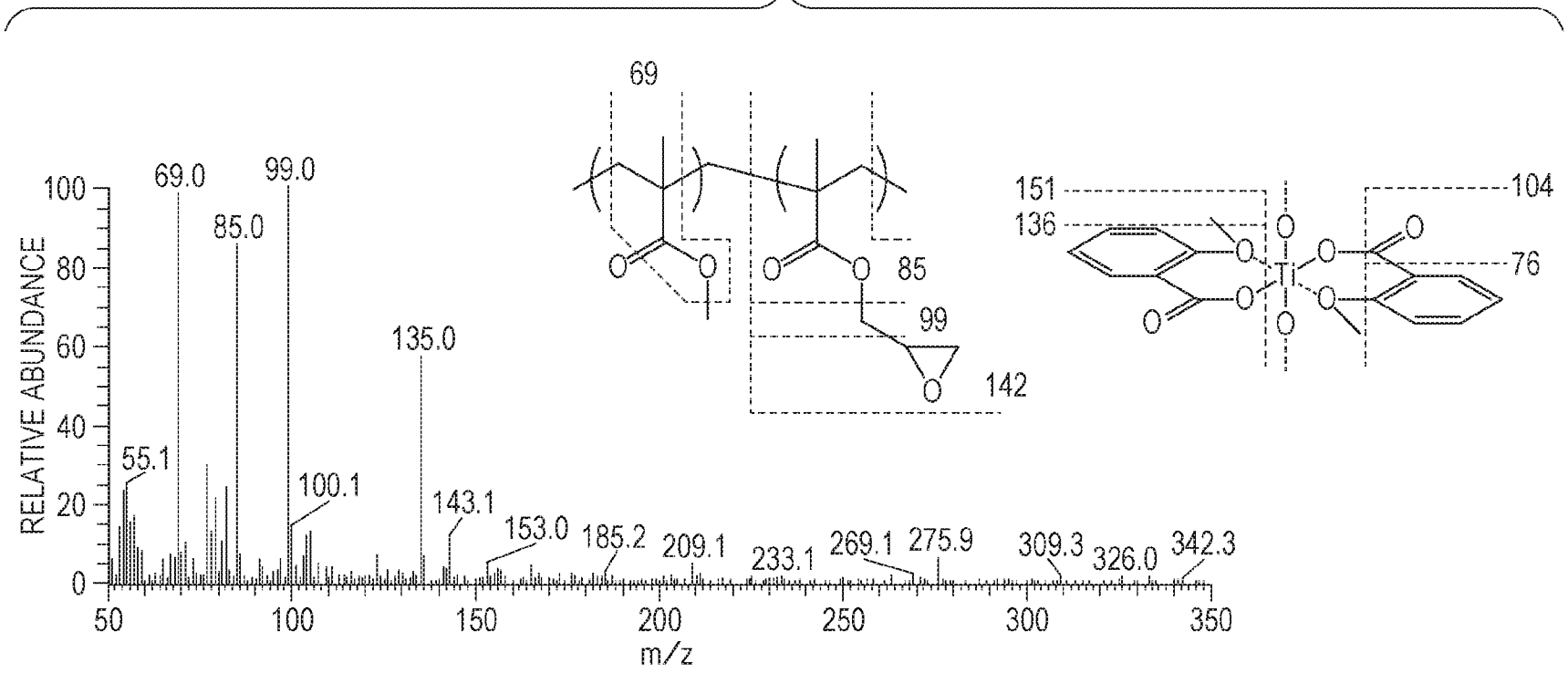
FIGS. 5A and 5B are diagrams showing the results of micro-MS analysis of an example of a surface layer.
Figure 5B:
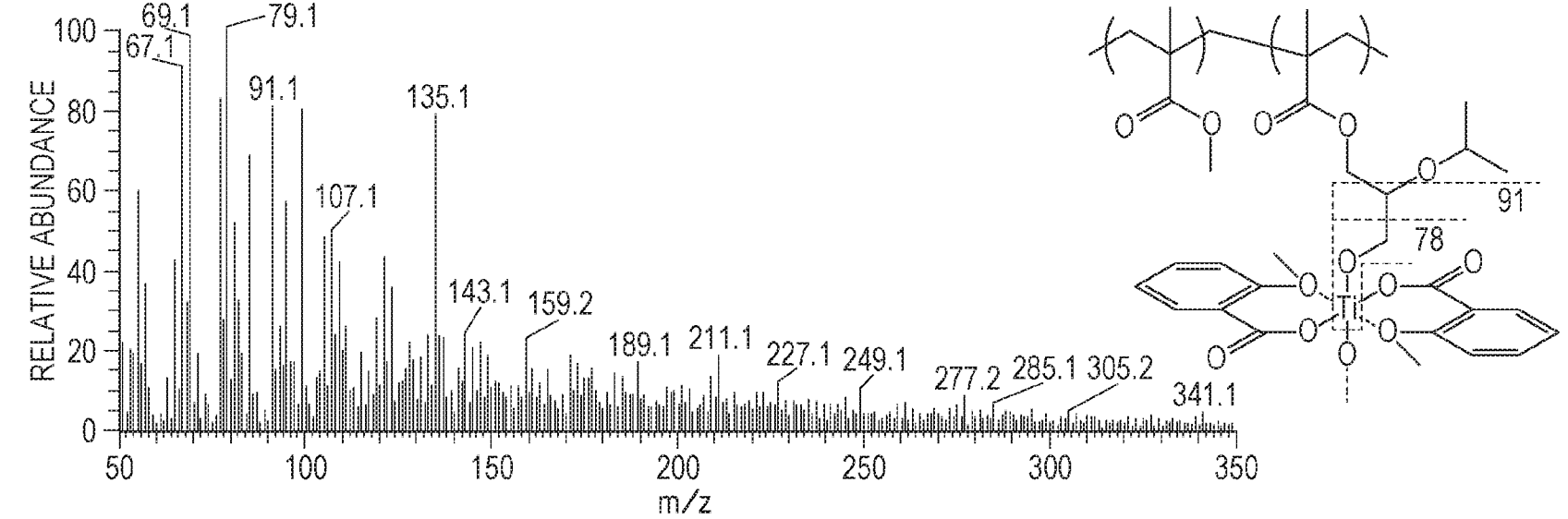

FIG. 5A is a MS spectrum of a peak at a retention time of 0.92 minutes in FIG. 4, and FIG. 5B is a MS spectrum of a peak at a retention time of 1.01 minutes in FIG. 4.

Figure 6A:
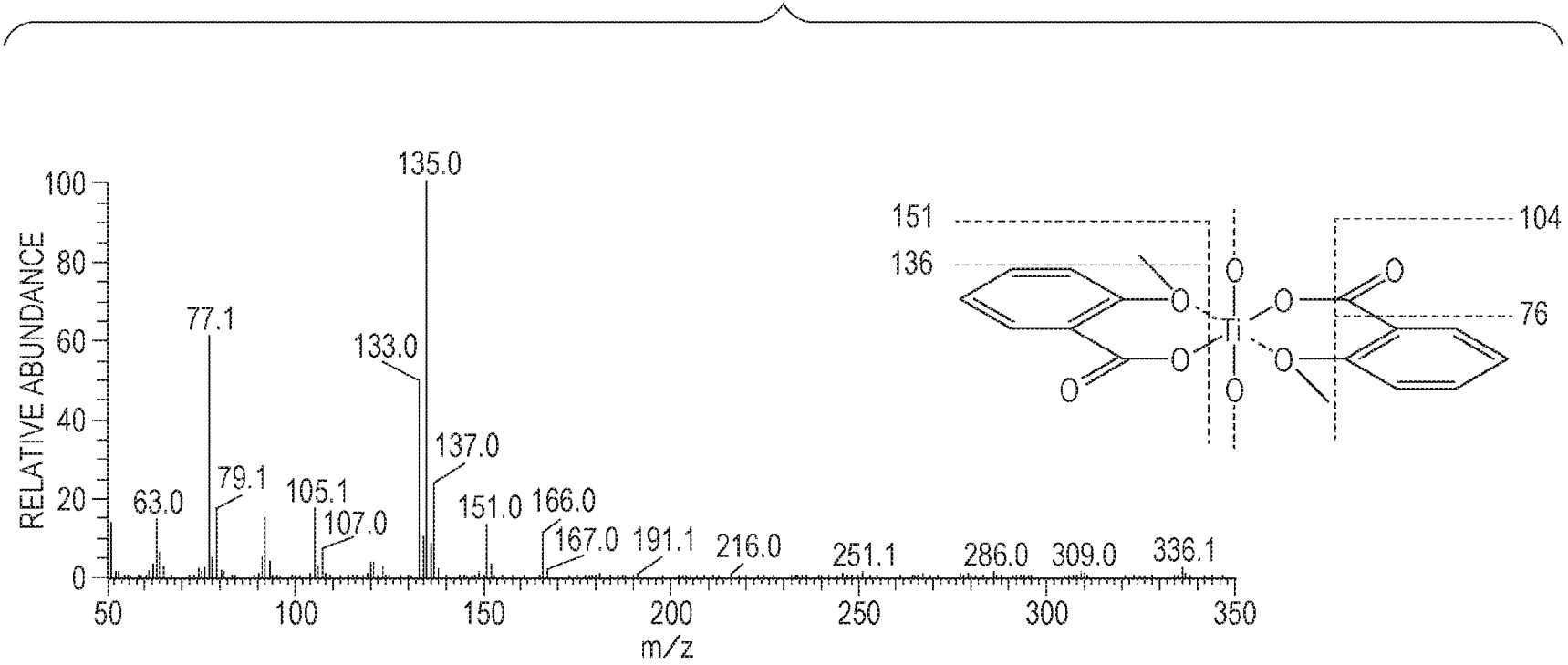
FIGS. 6A and 6B are diagrams showing the results of micro-MS analysis of raw materials of a surface layer.

FIG. 6A is a MS spectrum of the measurement sample prepared from the metal complex solution.

Figure 6B:
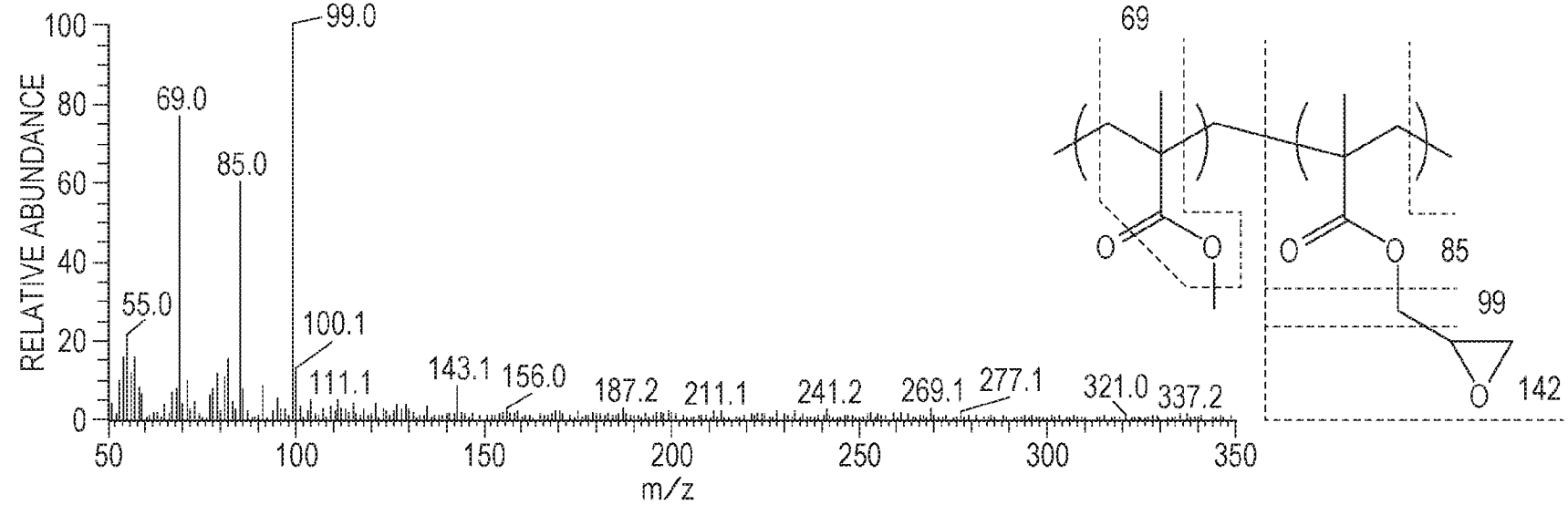

FIG. 6B is a MS spectrum of the measurement sample prepared from the epoxy group-containing polymer solution, specifically, the epoxy group-containing polymer ("Ma-Proof G-0150M").

In addition, an estimated structure of a fragment is also shown in each of the MS spectra.

It is considered from the MS spectrum of FIG. 5A that the peak at a retention time of 0.92 minutes in the total ion chromatogram of FIG. 4 is a peak of unreacted materials of the epoxy group-containing polymer and the metal complex, that is, a mixture of the epoxy group-containing polymer simple material and the metal complex simple material. It is also considered from the MS spectrum of FIG. 5B that the peak at a retention time of 1.01 minutes in the total ion chromatogram of FIG. 4 is a peak of a reaction product of the epoxy group-containing polymer and the metal complex.

Further, comparing the spectra of FIGS. 5A and 5B with the spectra of FIGS. 6A and 6B, a fragmentation pattern not observed in the MS spectrum of the measurement sample prepared from the metal complex solution or the epoxy group-containing polymer solution is recognized at m/z=79 and 91 in the MS spectrum of the surface layer of the charging member E1. This is estimated to be due to fragment derived from the reaction product of titanium in the metal complex and an epoxy group in the resin.

[Evaluation 1: Evaluation of Occurrence of Abnormal Discharge]

A charging roller mounted on a cyan cartridge for a laser printer (trade name: HP Color Laser Jet CP4525, manufactured by HP Corporation) was replaced by the produced charging member E1. Also, a photosensitive member including a charge-transport layer having a thickness of 27 μm was separately prepared and used in place of a photosensitive member mounted on the cartridge. The cartridge was set in the laser printer (trade name: HP Color Laser Jet CP4525, manufactured by HP Corporation), and a halftone image was formed on A4-size paper. In forming an electrophotographic image, pre-exposure was not performed, and the charge voltage and the transfer voltage were set to −1450 V and 2575 V, respectively. The setting was intended to create an environment where abnormal discharge more easily occurred. The electrophotographic image was output in a low-temperature low-humidity environment (temperature: 15° C., humidity: 10%).

The obtained halftone image was evaluated by visual observation on the basis of criteria below.

Rank A: The occurrence of unevenness (unevenness of about several tens μm to several mm) due to abnormal discharge was not recognized.

Rank B: The occurrence of unevenness (unevenness of about several tens μm to several mm) due to abnormal discharge was recognized.

[Evaluation 2: Durability Evaluation]

A charging roller mounted on a cyan cartridge for a laser printer (trade name: HP Color Laser Jet CP4525, manufactured by HP Corporation) was replaced by the produced charging member E1. The cartridge described above was set in the laser printer (trade name: HP Color Laser Jet CP4525, manufactured by HP Corporation), and an image forming operation described below was performed in an environment at a temperature of 23° C. and a relative humidity of 50%. That is, an image of 4 point-size alphabet "E" was printed at a printing rate of 1% on 300,000 sheets of A4-size paper. In addition, when the image was continuously output on two sheets, the rotation of the photosensitive member was temporarily stopped for 7 seconds, that is, the image output was performed in an intermittent mode. After output of the image on 300,000 sheets, a halftone image was output on one sheet of A4-size paper. The electrophotographic image was output in a low-temperature low-humidity environment (temperature: 15° C., humidity: 10%).

The presence of a "spot" (dot)-shaped defect on the halftone image due to dirt on the surface of the charging member was determined by visual observation of the obtained halftone image on the basis of criteria below.

Rank A: The occurrence of "spot" was not recognized.

Rank B: The occurrence of slight "spot" was recognized.

Rank C: The occurrence of "spot" was recognized at a position corresponding to the rotational pitch of the charging member.

Rank D: The occurrence of "spot" was recognized over the entire surface of the image.

Examples 2 to 16

Charging member E2 to charging member E16 were formed and evaluated by the same method as in Example 1 except that the coating solution E2 to coating solution E16 were used. The evaluation results are summarized in Table 8.

Comparative Examples 1 and 2

Charging member C1 and charging member C2 were formed and evaluated by the same method as in Example 1 except that the coating solution C1 and the coating solution C2 were used. The evaluation results are summarized in Table 8. Abnormal discharge and spot images were observed with the charging member C1 and the charging member C2.

TABLE 8

| | Charging member No. | Evaluation 1 Evaluation rank | Evaluation 2 Evaluation rank |
|---|---|---|---|
| Example 1 | Charging member E1 | A | A |
| Example 2 | Charging member E2 | A | C |
| Example 3 | Charging member E3 | A | B |
| Example 4 | Charging member E4 | A | A |
| Example 5 | Charging member E5 | A | A |
| Example 6 | Charging member E6 | A | A |
| Example 7 | Charging member E7 | A | B |
| Example 8 | Charging member E8 | A | C |
| Example 9 | Charging member E9 | A | A |
| Example 10 | Charging member E10 | A | B |
| Example 11 | Charging member E11 | A | A |
| Example 12 | Charging member E12 | A | B |
| Example 13 | Charging member E13 | A | A |
| Example 14 | Charging member E14 | A | C |
| Example 15 | Charging member E15 | A | A |
| Example 16 | Charging member E16 | A | C |
| Comparative Example 1 | Charging member C1 | B | D |
| Comparative Example 2 | Charging member C2 | B | D |

Examples 17 to 32

For the charging member E1, the transfer voltage in evaluation 1 was stepwisely increased from 1856 V, and the occurrence of abnormal discharge was evaluated at each of the voltages based on the same criteria as in evaluation 1. As a result, abnormal discharge was first observed at a transfer voltage of 2575 V. The same evaluation was performed for the charging members E2 to E16, and values of the transfer voltage at which abnormal discharge was first observed were recorded. The results are shown in Table 9.

TABLE 9

| | Charging member No. | Transfer voltage at occurrence of abnormal discharge (V) |
|---|---|---|
| Example 17 | Charging member E1 | 2575 |
| Example 18 | Charging member E2 | 2215 |
| Example 19 | Charging member E3 | 2455 |
| Example 20 | Charging member E4 | 2575 |
| Example 21 | Charging member E5 | 2575 |
| Example 22 | Charging member E6 | 2575 |
| Example 23 | Charging member E7 | 2335 |
| Example 24 | Charging member E8 | 2215 |
| Example 25 | Charging member E9 | 2575 |
| Example 26 | Charging member E10 | 2335 |
| Example 27 | Charging member E11 | 2575 |
| Example 28 | Charging member E12 | 2335 |
| Example 29 | Charging member E13 | 2575 |
| Example 30 | Charging member E14 | 2096 |
| Example 31 | Charging member E15 | 2455 |
| Example 32 | Charging member E16 | 2096 |

The results described above reveal that the charging member according to an embodiment of the present disclosure can suppress the occurrence of image unevenness due to significantly abnormal discharge. Also, the occurrence of defects in an electrophotographic image due to dirt of the surface of the charging member can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-129033, filed Jun. 26, 2015, which is hereby incorporated by reference herein in its entirety.

What is claimed is:

1. A charging member comprising:

a support; and a surface layer on the support, wherein the surface layer contains a compound represented by a following formula (a):

(a)

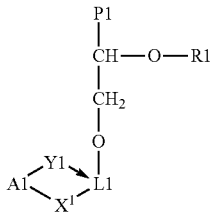

in the formula (a),

P1 represents a resin,

R1 represents a hydrogen atom or an alkyl group having 1 to 4 carbon atoms,

L1 represents polymetalloxane having a structural unit represented by $M1O_{n/2}$ wherein M1 represents at least one metal atom selected from the group consisting of Ti, Zr, Hf, V, Nb, Ta, W, Al, Ga, In, and Ge, when metal atom M1 has a valence of p, n represents an integer of 1 or more and p or less, and X1 represents any one of structures represented by the following formulae (1) to (4):

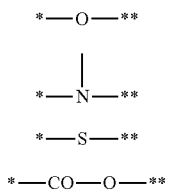

(1)

(2)

(3)

(4)

in the formulae (1) to (4), "*" represents a bonding site with A1, and "**" represents a bonding site with M1 in L1, Y1 represents a group having a site coordinated with M1 in L1, and (i) when X1 is a structure represented by the formula (1), A1 represents an atomic group necessary for forming a 4- to 8-member ring together with M1, X1, and Y1, and containing an aromatic ring in which a carbon atom constituting the aromatic ring is bonded to an oxygen atom of X1, and (ii) when X1 is a structure represented by any one of the formulae (2) to (4), A1 represents a bond or atomic group necessary for forming a 4- to 8-member ring together with M1, X1, and Y1.

2. The charging member according to claim 1, wherein Y1 is a hydroxyl group, an alkoxy group, a substituted or unsubstituted aryloxy group, a carbonyl group, an alkylthio group, a substituted or unsubstituted arylthio group, a thiocarbonyl group, a substituted or unsubstituted amino group, a substituted or unsubstituted imino group, a group having a substituted or unsubstituted aliphatic heterocyclic skeleton, or a group having a substituted or unsubstituted aromatic heterocyclic skeleton.

3. The charging member according to claim 1, wherein X1 is a structure represented by the formula (1), and A1 is an atomic group containing an aromatic ring selected from the group consisting of substituted or unsubstituted benzene ring, substituted or unsubstituted naphthalene ring, substituted or unsubstituted pyrrole ring, substituted or unsubstituted thiophene ring, substituted or unsubstituted furan ring, substituted or unsubstituted pyridine ring, substituted or unsubstituted indole ring, substituted or unsubstituted benzothiophene ring, substituted or unsubstituted benzofuran ring, substituted or unsubstituted quinoline ring, and substituted or unsubstituted isoquinoline ring.

4. The charging member according to claim 1, wherein X1 is a structure represented by any one of the formulae (2) to (4), and A1 is a bond, an alkylene group, or an atomic group containing an aromatic ring selected from the group consisting of substituted or unsubstituted benzene ring, substituted or unsubstituted naphthalene ring, substituted or unsubstituted pyrrole ring, substituted or unsubstituted thiophene ring, substituted or unsubstituted furan ring, substituted or unsubstituted pyridine ring, substituted or unsubstituted indole ring, substituted or unsubstituted benzothiophene ring, substituted or unsubstituted benzofuran ring, substituted or unsubstituted quinoline ring, and substituted or unsubstituted isoquinoline ring.

5. The charging member according to claim 1, wherein the resin is an acrylic resin, an epoxy resin, or a phenol resin.

6. The charging member according to claim 5, wherein the resin is an acrylic resin.

7. The charging member according to claim 6, wherein the surface layer has a structural unit represented by the following formula (11):

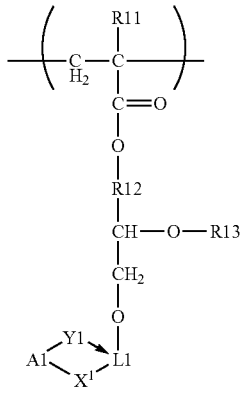

(11)

in the formula (11),

R11 represents a hydrogen atom or a methyl group,

R12 represents a divalent hydrocarbon group having 1 to 4 carbon atoms, and

R13 represents a hydrogen atom or a hydrocarbon group having 1 to 4 carbon atoms.

8. The charging member according to claim 7, wherein the acrylic resin further has either or both of a structural unit represented by the following formula (12) and a structural unit represented by the following formula (13):

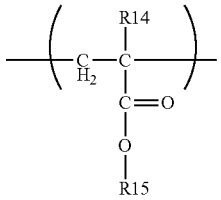

(12)

in the formula (12), R14 represents a hydrogen atom or a methyl group, and R15 represents a hydrogen atom or a hydrocarbon group having 1 to 8 carbon atoms, (13)

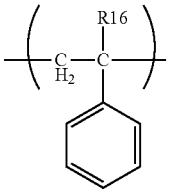

in the formula (13), R16 represents a hydrogen atom or a methyl group.

9. The charging member according to claim 1, wherein a ring formed by A1, M1, X1, and Y1 is a 5 member ring or a 6 member ring.

10. A charging member comprising:

a support; and a surface layer on the support, wherein the surface layer contains a compound represented by a following formula (b):

(b)

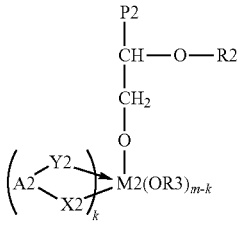

in the formula (b),

P2 represents a resin,

R2 represents a hydrogen atom or an alkyl group having 1 to 4 carbon atoms,

M2 represents at least one metal atom selected from the group consisting of Ti, Zr, Hf, V, Nb, Ta, N, Al, Ga, In, and Ge, R3 represents a hydrogen atom or a hydrocarbon group having 1 to 4 carbon atoms, when metal atom M2 has a valence of q, m represents q−1, and k represents an integer of 1 or more and m or less, and X2 represents any one of structures represented by the following formulae (5) to (8):

(5)

(6)

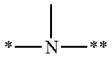

(7)

(8)

in the formulae (5) to (8), "*" represents a bonding site with A2, and "*" represents a bonding site with M2, Y2 represents a group having a site coordinated with M2, and (i) when X2 is a structure represented by the formula (5), A2 represents an atomic group necessary for forming a 4- to 8-member ring together with M2, X2, and Y2, and containing an aromatic ring in which a carbon atom constituting the aromatic ring is bonded to an oxygen atom of X2, and (ii) when X2 is a structure represented by any one of the formulae (6) to (8), A2 represents a bond or atomic group necessary for forming a 4- to 8-member ring together with M2, X2, and Y2.

11. A process cartridge configured to be detachable from an electrophotographic apparatus body, the process cartridge comprising:

an electrophotographic photosensitive member; and a charging member disposed to be capable of charging the surface of the electrophotographic photosensitive member, wherein the charging member includes a support and a surface layer on the support, and the surface layer contains either or both of a compound represented by formula (a) below and a compound represented by formula (b) below:

(a)

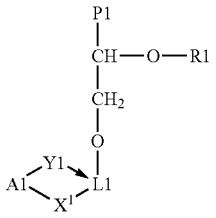

in the formula (a),

P1 represents a resin,

R1 represents a hydrogen atom or an alkyl group having 1 to 4 carbon atoms,

L1 represents polymetalloxane having a structural unit represented by $M1O_{n/2}$ wherein M1 represents at least one metal atom selected from the group consisting of Ti, Zr, Hf, V, Nb, Ta, W, Al, Ga, In, and Ge, when metal atom M1 has a valence of p, n represents an integer of 1 or more and p or less, and X1 represents any one of structures represented by the following formulae (1) to (4):

(1)

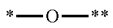

(2)

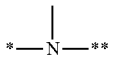

(3)

(4)

in the formulae (1) to (4), "*" represents a bonding site with A1, and "*" represents a bonding site with M1 in L1, Y1 represents a group having a site coordinated with M1 in L1, and (i) when X1 is a structure represented by the formula (1), A1 represents an atomic group necessary for forming a 4- to 8-member ring together with M1, X1, and Y1, and containing an aromatic ring in which a carbon atom constituting the aromatic ring is bonded to an oxygen atom of X1, and (ii) when X1 is a structure represented by any one of the formulae (2) to (4), A1 represents a bond or atomic group necessary for forming a 4- to 8-member ring together with M1, X1, and Y1, (b)

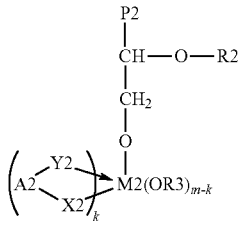

in the formula (b),

P2 represents a resin,

R2 represents a hydrogen atom or an alkyl group having 1 to 4 carbon atoms,

M2 represents at least one metal atom selected from the group consisting of Ti, Zr, Hf, V, Nb, Ta, W, Al, Ga, In, and Ge, R3 represents a hydrogen atom or a hydrocarbon group having 1 to 4 carbon atoms, when metal atom M2 has a valence of q, m represents q−1, and k represents an integer of 1 or more and m or less, and X2 represents any one of structures represented by the following formulae (5) to (8):

(5)

(6)

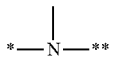

(7)

(8)

in the formulae (5) to (8), "*" represents a bonding site with A2, and "*" represents a bonding site with M2, Y2 represents a group having a site coordinated with M2, and (i) when X2 is a structure represented by the formula (5), A2 represents an atomic group necessary for forming a 4- to 8-member ring together with M2, X2, and Y2, and containing an aromatic ring in which a carbon atom constituting the aromatic ring is bonded to an oxygen atom of X2, and (ii) when X2 is a structure represented by any one of the formulae (6) to (8), A2 represents a bond or atomic group necessary for forming a 4- to 8-member ring together with M2, X2, and Y2.

12. An electrophotographic apparatus comprising:

an electrophotographic photosensitive member; and a charging member disposed to be capable of charging the surface of the electrophotographic photosensitive member, wherein the charging member includes a support and a surface layer on the support, and the surface layer contains either or both of a compound represented by formula (a) below and a compound represented by formula (b) below:

(a)

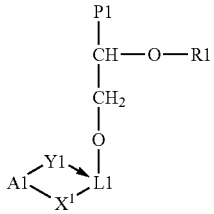

in the formula (a),

P1 represents a resin,

R1 represents a hydrogen atom or an alkyl group having 1 to 4 carbon atoms,

L1 represents polymetalloxane having a structural unit represented by $M1O_{n/2}$ wherein M1 represents at least one metal atom selected from the group consisting of Ti, Zr, Hf, V, Nb, Ta, W, Al, Ga, In, and Ge, when metal atom M1 has a valence of p, n represents an integer of 1 or more and p or less, and X1 represents any one of structures represented by the following formulae (1) to (4):

(1)

(2)

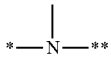

(3)

(4)

in the formulae (1) to (4), "*" represents a bonding site with A1, and "*" represents a bonding site with M1 in L1, Y1 represents a group having a site coordinated with M1 in L1, and (i) when X1 is a structure represented by the formula (1), A1 represents an atomic group necessary for forming a 4- to 8-member ring together with M1, X1, and Y1, and containing an aromatic ring in which a carbon atom constituting the aromatic ring is bonded to an oxygen atom of X1, and (ii) when X1 is a structure represented by any one of the formulae (2) to (4), A1 represents a bond or atomic group necessary for forming a 4- to 8-member ring together with M1, X1, and Y1, (b)

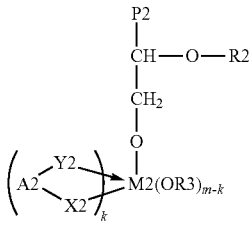

in the formula (b),

P2 represents a resin,

R2 represents a hydrogen atom or an alkyl group having 1 to 4 carbon atoms,

M2 represents at least one metal atom selected from the group consisting of Ti, Zr, Hf, V, Nb, Ta, W, Al, Ga, In, and Ge, R3 represents a hydrogen atom or a hydrocarbon group having 1 to 4 carbon atoms, when metal atom M2 has a valence of q, m represents q−1, and k represents an integer of 1 or more and m or less, and X2 represents any one of structures represented by the following formulae (5) to (8):

(5)

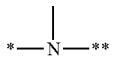

(6)

(7)

-continued

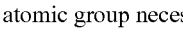

(8)

in the formulae (5) to (8), "*" represents a bonding site with A2, and "**" represents a bonding site with M2, Y2 represents a group having a site coordinated with M2, and (i) when X2 is a structure represented by the formula (5), A2 represents an atomic group necessary for forming a to 8-member ring together with M2, X2, and Y2, and containing an aromatic ring in which a carbon atom constituting the aromatic ring is bonded to an oxygen atom of X2, and (ii) when X2 is a structure represented by any one of the formulae (6) to (8), A2 represents a bond or atomic group necessary for forming a 4- to 8-member ring together with M2, X2, and Y2.

* * * * *